US008215501B2

(12) United States Patent
Trettin et al.

(10) Patent No.: US 8,215,501 B2
(45) Date of Patent: Jul. 10, 2012

(54) ADJUSTABLE CURTAIN ROD

(75) Inventors: David J. Trettin, Atlanta, GA (US); John DeWees, Morristown, NJ (US); Gary E. Van Deursen, Essex, CT (US); William D. Hill, Farmington, CT (US)

(73) Assignee: Focus Products Group, LLC, Vernon Hills, IL (US)

( * ) Notice: Subject to any disclaimer, the term of this patent is extended or adjusted under 35 U.S.C. 154(b) by 434 days.

(21) Appl. No.: 12/536,110

(22) Filed: Aug. 5, 2009

(65) Prior Publication Data

US 2011/0031198 A1 Feb. 10, 2011

(51) Int. Cl.
*A47H 1/02* (2006.01)

(52) U.S. Cl. ..... 211/105.2; 211/105.4; 211/105.6

(58) Field of Classification Search .... 211/105.2–105.6, 211/107, 123; 4/557, 558, 608, 609, 661; 16/87.4 R, 87.2; 248/251, 256, 354.1, 264, 248/265, 354.3
See application file for complete search history.

(56) References Cited

U.S. PATENT DOCUMENTS

| | | | | |
|---|---|---|---|---|
| 297,136 | A | | 4/1884 | La Dow |
| 839,959 | A | | 1/1907 | Richards |
| 912,789 | A | | 2/1909 | Berbecker |
| 1,256,849 | A | | 2/1918 | Vaudreuil |
| 1,292,969 | A | | 1/1919 | Sturgis |
| 1,487,017 | A | | 3/1924 | Lilja |
| 1,675,111 | A | | 6/1928 | Kenney |
| 1,681,010 | A | | 8/1928 | Raggio |
| 2,011,662 | A | | 8/1935 | Thompson |
| 2,131,156 | A | | 9/1938 | Yardley |
| 2,184,358 | A | * | 12/1939 | Moore ..... 285/302 |
| D119,576 | S | | 3/1940 | Kirsch |
| 2,195,979 | A | | 4/1940 | Ziolkowski |
| 2,219,075 | A | | 10/1940 | Le Veau |
| 2,383,104 | A | | 8/1945 | Allen |
| 2,573,985 | A | | 11/1951 | Porter |
| 2,650,714 | A | | 9/1953 | Brose et al. |
| 2,698,094 | A | | 12/1954 | Simpson |
| 2,774,974 | A | | 12/1956 | Zaloga |
| 2,778,030 | A | | 1/1957 | Goche |
| 2,796,227 | A | | 6/1957 | Coakley |
| 2,878,487 | A | | 3/1959 | Foote |
| 2,890,799 | A | | 6/1959 | Rosenbaum |
| 2,902,592 | A | * | 9/1959 | Cole et al. ..... 362/277 |
| 3,004,784 | A | * | 10/1961 | Selby ..... 403/19 |

(Continued)

FOREIGN PATENT DOCUMENTS

WO 2006052753 5/2006

OTHER PUBLICATIONS

AU 111109 S (Lesis Kenneth Brown) May 23, 1991 [online] [retrieved May 19, 2007]. Retrieved from Australian patent database.

(Continued)

*Primary Examiner* — Korie H. Chan
(74) *Attorney, Agent, or Firm* — Michael Best & Friedrich LLP

(57) ABSTRACT

An adjustable curtain rod assembly includes a rod member and an adjustment mechanism coupled to an end of the rod member. The adjustment mechanism is operable to adjust a length of the rod assembly and has a clutch mechanism that prevents over-extension of the rod assembly during mounting.

18 Claims, 17 Drawing Sheets

U.S. PATENT DOCUMENTS 3,107,361 A 10/1963 Glutting, Sr.
3,418,665 A 12/1968 Long
3,521,758 A 7/1970 Guilfoyle
3,557,390 A 1/1971 Ruggles et al.
3,737,921 A 6/1973 Baumrind
3,750,818 A 8/1973 Borstcher
3,872,520 A 3/1975 Tyconik
3,880,394 A 4/1975 Wisecarver
D236,864 S 9/1975 Tegner
4,043,528 A 8/1977 Benoit et al.
4,117,557 A 10/1978 McPeak et al.
4,229,842 A 10/1980 Gilmore
4,361,914 A 12/1982 Oliver
4,496,059 A 1/1985 Leiter
4,659,051 A 4/1987 Propp et al.
4,737,056 A * 4/1988 Hunt ..... 410/151
4,754,504 A 7/1988 Cellini
4,767,013 A 8/1988 Bertelli
4,775,056 A 10/1988 Inglis
5,022,104 A 6/1991 Miller
5,031,257 A 7/1991 Jeffery
D318,968 S 8/1991 Poulson
5,056,753 A 10/1991 Lunau et al.
5,103,531 A 4/1992 Perrotta
5,174,352 A * 12/1992 Murray et al. ..... 160/67
5,189,759 A 3/1993 Poore
5,231,708 A 8/1993 Hansen
D340,376 S 10/1993 Klose
5,281,063 A * 1/1994 Austin, III ..... 410/151
5,330,061 A 7/1994 Geltz
5,402,842 A 4/1995 Ruggiero
5,458,310 A 10/1995 Johnson
5,513,419 A 5/1996 Zinger
5,538,364 A 7/1996 Huntsman
D374,167 S 10/1996 Scholl
5,615,721 A 4/1997 Winter
5,662,297 A 9/1997 Christensen et al.
D393,390 S 4/1998 Gottwald
5,794,281 A 8/1998 Shearon
D397,928 S 9/1998 Wise
5,803,782 A * 9/1998 Selton ..... 446/126
5,894,610 A 4/1999 Winter
5,941,527 A * 8/1999 Selton ..... 273/276
6,024,331 A 2/2000 Bischoff et al.
6,032,306 A 3/2000 Gummin
D426,142 S 6/2000 Moore
6,138,970 A 10/2000 Sohrt et al.
6,154,894 A 12/2000 Alexander et al.
6,216,287 B1 4/2001 Wise
6,263,523 B1 7/2001 Moore
6,296,287 B1 10/2001 Kinbara et al.
D462,425 S 9/2002 Tse
D466,351 S 12/2002 Tai
6,688,479 B2 2/2004 Nei
6,694,543 B2 * 2/2004 Moore ..... 4/610
D499,954 S 12/2004 Brushaber
6,857,140 B1 2/2005 Broudy
6,857,247 B2 * 2/2005 Adams ..... 52/656.9
D542,897 S 5/2007 Harwanko
7,222,376 B1 5/2007 Gunning
D552,455 S 10/2007 Moore
D557,590 S 12/2007 Moore
D565,395 S 4/2008 Moore et al.
D565,710 S 4/2008 Cropelli
D567,637 S 4/2008 Moore
D586,647 S 2/2009 Didehvar
D590,698 S 4/2009 Moore et al.
7,512,997 B2 4/2009 Dewees
7,708,317 B2 * 5/2010 Leblanc ..... 285/31
D631,734 S 2/2011 Fernandez et al.
D633,780 S 3/2011 Barrese
D634,609 S 3/2011 Bauer
D648,619 S 11/2011 Lowe
8,056,873 B1 11/2011 Hanley et al.
8,069,507 B2 12/2011 Didehvar et al.
2002/0014568 A1 2/2002 Faucher et al.
2004/0107493 A1 6/2004 Orpilla
2004/0237701 A1 * 12/2004 Hilss et al. ..... 74/525
2005/0268394 A1 12/2005 Monk et al.
2006/0070177 A1 4/2006 Bathurst et al.
2006/0096023 A1 5/2006 Dewees
2007/0006377 A1 1/2007 Moore
2007/0006378 A1 1/2007 Moore
2007/0174956 A1 8/2007 Heaslip
2008/0115265 A1 5/2008 Heaslip
2008/0282464 A1 11/2008 Bauer

OTHER PUBLICATIONS

AU 136336 S (Council of the City of Sydney) Feb. 3, 1999 [online] [retrieved May 19, 2007]. Retrieved from Australian patent database.
International Search Report/Written Opinion for PCT/US05/40016, dated Mar. 30, 2007.

* cited by examiner

ADJUSTABLE CURTAIN ROD

BACKGROUND

The present invention relates to adjustable curtain rods, and more particularly to adjustable curtain rods for shower curtains.

Adjustable shower curtain rods are known. A common adjustable rod, sometimes referred to as a tension rod, takes the form of a telescoping, two-piece rod. The two rod halves can be rotated relative to one another to shorten or lengthen the rod to fit the shower or bath enclosure.

SUMMARY

The invention provides an improved adjustable curtain rod having a clutch mechanism operable to prevent excessive extension of the rod. Such excessive extension might otherwise lead to damage to the support surfaces of the shower or bath enclosure. The inventive rod can be embodied in both straight and curved curtain rods.

In one embodiment, the invention provides an adjustable curtain rod assembly including a rod member and an adjustment mechanism coupled to an end of the rod member. The adjustment mechanism is operable to adjust a length of the rod assembly and has a clutch mechanism that prevents overextension of the rod assembly during mounting.

In another embodiment the invention provides an adjustable curtain rod assembly including a rod member and an adjustment mechanism coupled to an end of the rod member. The adjustment mechanism is operable to adjust a length of the rod assembly and has an overrunning clutch mechanism operable to permit extension of the rod assembly to a first length that creates a first compressive force on a support surface to which the rod assembly is being coupled, and that prevents extension of the rod assembly to a second length longer than the first length and that would create a second compressive force greater than the first compressive force on the support surface.

The invention also provides an embodiment of an adjustable arcuate curtain rod in which the clutch mechanism can be removed from the adjustment mechanism due to the flexibility of the arcuate rod and the non-perpendicular direction of force transmission relative to the mounting surfaces. The ability of the rod to bow between opposing mounting surfaces, and the fact that force is not transmitted in a direction normal to the mounting surfaces, enables the adjustment mechanism to safely operate without a clutch mechanism.

More specifically, the invention also provides an adjustable curved curtain rod assembly including a curved rod member and an adjustment mechanism coupled to an end of the curved rod member. The adjustment mechanism is operable to adjust a length of the rod assembly and has a handle rotatable relative to the curved rod member, and a mounting shaft coupled with the handle. Rotation of the handle causes relative extension and retraction between the mounting shaft and the curved rod member to respectively increase and decrease the length of the rod assembly.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
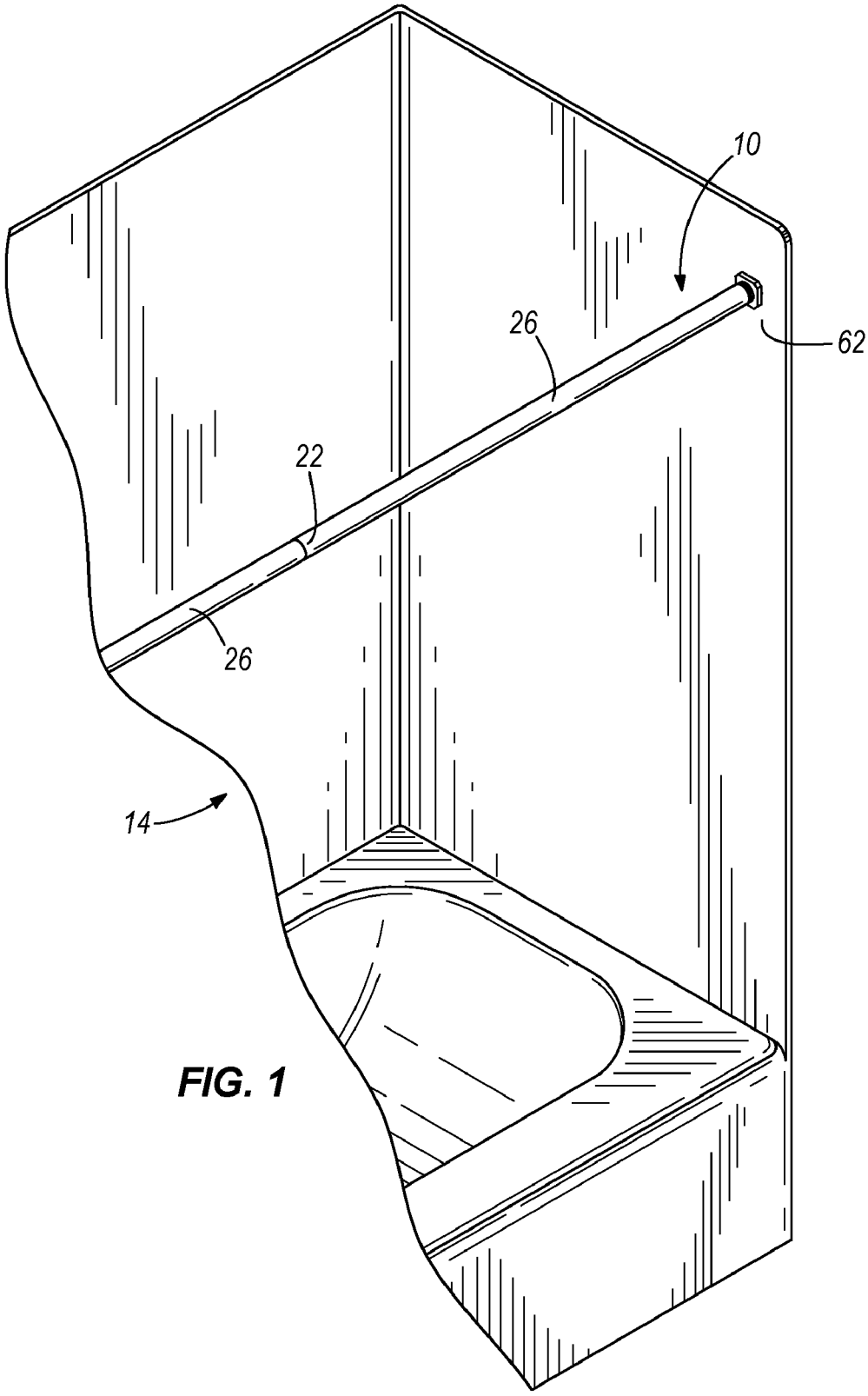
FIG. 1 is a partial perspective view of an adjustable curtain rod assembly embodying the present invention mounted in a shower enclosure.

FIG. 1 illustrates an adjustable curtain rod assembly 10 that is a first embodiment of the present invention. The illustrated rod assembly 10 is shown installed on a shower or bath enclosure 14 such that a curtain (not shown) supported by the rod assembly 10 encloses the shower or bath to substantially contain water, to provide privacy to the occupant, and to provide a decorative feature to the bathroom. However, it is to be understood that the rod assembly 10 need not be used exclusively for bath and shower applications, but can be used for other applications utilizing a curtain or support rod (e.g., window treatments, dividers, etc.). The illustrated rod assembly 10 is a straight rod assembly, however, as will be discussed below, the invention is also contemplated for use with curved rod assemblies.

Figure 2:
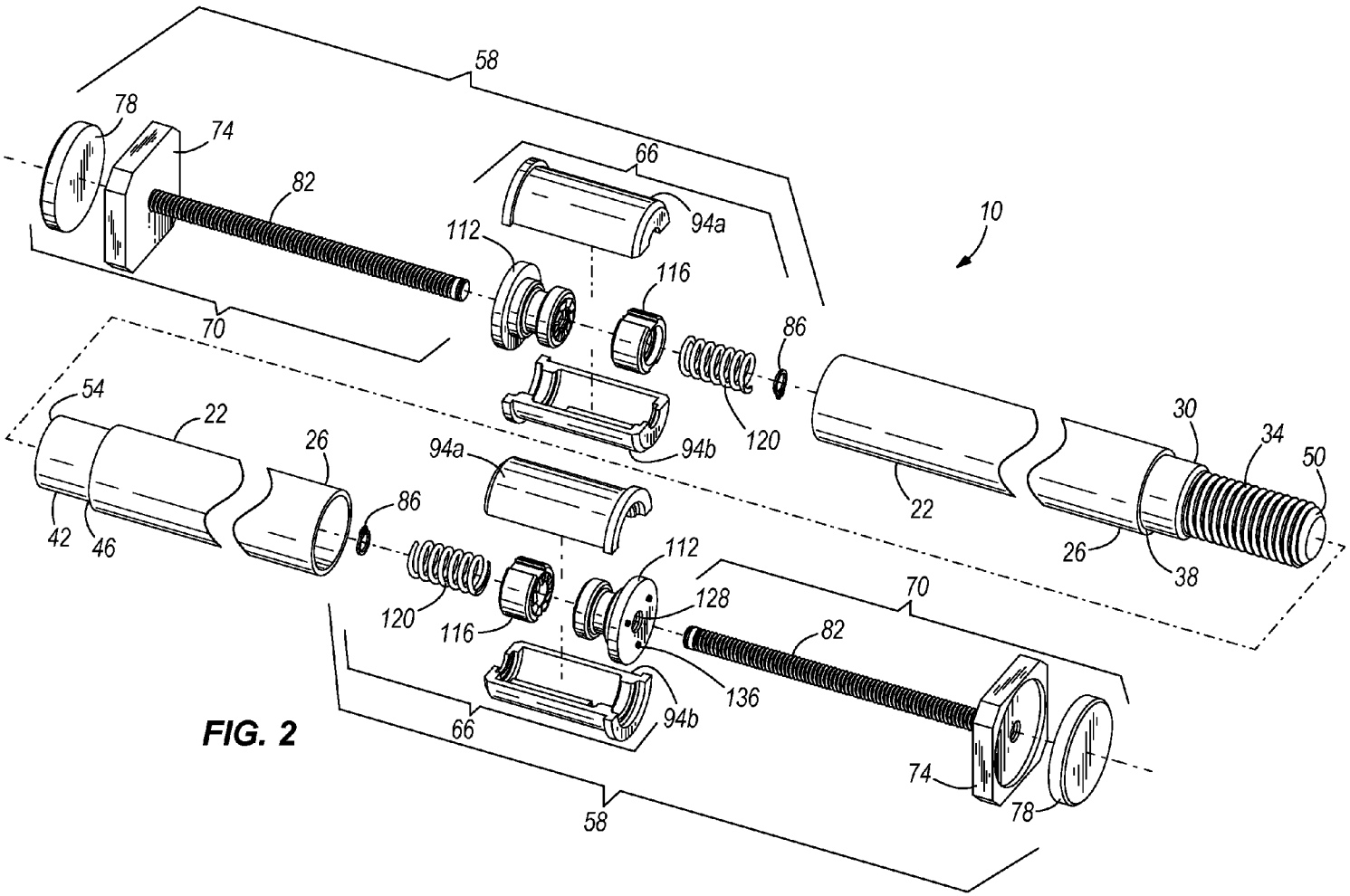
FIG. 2 is an exploded view of the adjustable curtain rod assembly of FIG. 1.

Referring now to FIG. 2, the rod assembly 10 includes a rod member 22, which in the illustrated embodiment can be made from any of low carbon steel, stainless steel, or aluminum and includes two distinct, tubular rod halves or rod members 26 interconnected together by a connector assembly 30. The connector assembly 30 includes a male connector 34 having a first end 38 sized and configured to be secured (e.g., pressed) into an open end of one rod member 26, and a female connector 42 having a first end 46 sized and configured to be secured (e.g., pressed) into an open end of the other rod member 26. To assemble the rod members 26 together, a second end 50 of the male connector 34 is inserted into a second end 54 of the female connector 42. In the illustrated embodiment, the second end 50 of the male connector 34 is threaded to be received by mating threads in the second end 54 of the female connector 42. The illustrated connector assembly 30 is made from plastic (e.g., nylon), but other materials can also be used. In other embodiments, different securing arrangements can be used in place of the illustrated threaded engagement. Also, other embodiments may include a one-piece rod member 22, or a rod member 22 made up of more than two distinct rod portions, and other materials can be used for the rod members 26.

The illustrated rod member 22, even when assembled from the two distinct rod halves 26, defines an outer diameter of a constant dimension. This enables and facilitates both the use of a hookless curtain or a curtain supported by curtain rings. More specifically, and unlike many conventional telescoping curtain rod assemblies made from two rod halves of differing outer diameters, the illustrated rod member 22 of the constant outer diameter contains no discontinuities (e.g., steps or other changes in outer diameter) along the length of the rod member 22. Such discontinuities can make sliding the curtain along the rod member difficult.

The illustrated rod assembly 10 further includes an adjustment mechanism 58 coupled to each end of the rod member 22. In other embodiments, the rod assembly 10 could include only a single adjustment mechanism 58 at one end of the rod member 22. The adjustment mechanisms 58 are substantially the same with the exception of the orientation of certain components (e.g., threads, clutch teeth, etc.) depending upon which end of the rod assembly 10 they occupy, and thus, what directions of rotation they undergo to achieve extension and retraction of the rod assembly 10. In that regard, only one adjustment mechanism 58 will be discussed in detail, with the orientation-specific components being noted.

Each adjustment mechanism 58 is operable to adjust an overall length of the rod assembly 10 in order to fit the specific mounting dimension for the application of use. For example, there are standardized shower and bath enclosure dimensions, and the rod assembly 10 can be sized to have a length generally appropriate for a standard dimension. The adjustment mechanisms 58 provide the final adjustability so that the rod assembly 10 can be supported by the support surfaces 62 via pressure created by extending the length of the rod assembly 10 between the opposing support surfaces 62. Such pressure-mounted rod assemblies are often referred to as tension rods.

The adjustment mechanisms 58 of the present invention each include a clutch mechanism 66 that prevents over-extension of the rod assembly 10, thereby reducing or eliminating the likelihood of damaging the support surfaces 62 by over-extending the rod assembly 10. Prior art tension rods have been known to allow the user to over-extend the rods, thereby putting a large amount of pressure or compressive force on the support surfaces 62, leading to damage being inflicted on the support surfaces 62 (e.g., drywall, tile, plastic or ceramic enclosures, etc.).

Referring to FIGS. 2-5, the adjustment mechanism 58 includes a foot assembly 70 having a mounting foot 74, a resilient pressure pad 78, a threaded rod 82, and a snap ring 86. The pressure pad 78 is coupled to one side of the mounting foot 74 and is made of a suitable resilient material (e.g., rubber) for directly contacting the support surface 62. With the illustrated rod assembly 10, only the pressure pads 78 contact the support surfaces 62, and no permanent mounting brackets or structure are required on the mounting surfaces 62. The threaded rod 82 is non-rotatably secured to the mounting foot 74 such that the threaded rod 82 and the mounting foot 74 can rotate together. In the illustrated embodiment, the threaded rod 82 is threaded into a mating threaded bore 90 in the mounting foot 74 and an adhesive is applied to secure the engagement. The illustrated mounting foot 74 is made of metal (e.g., aluminum), but other materials can also be used. Of course, other suitable mounting arrangements can also be utilized. The threaded rod 82 is one of the components that is orientation specific, in that one of the threaded rods 82 will have right-hand threads while the threaded rod 82 at the other end of the rod assembly 10 will have left-hand threads. The illustrated threaded rods 82 are made of metal (e.g., nickel-plated steel).

The clutch mechanism 66 includes a clutch housing 94, that in the illustrated embodiment, is formed of two plastic (e.g., nylon), clutch housing halves 94*a* and 94*b*. The illustrated clutch housing 94, when assembled, is generally cylindrical and cup-shaped with a first, generally open end 100 adjacent the mounting foot 74, and a second, generally closed end 104 that defines a bore 108 through which the threaded rod 82 can extend. The snap ring 86, made of metal (e.g., stainless steel) in the illustrated embodiment, is sized to be larger than the bore 108 to prevent the distal end of the threaded rod 82 from passing completely through the bore 108 after assembled. The two clutch housing halves 94*a*, 94*b* can be secured together after assembly of the clutch mechanism 66 using adhesives, welding, or other suitable processes. Alternatively, the clutch housing halves 94*a*, 94*b* need not be independently secured together, but could be held together simply by the insertion into the end of the rod half 26, as discussed below.

The outer surface of the clutch housing 94 is sized and configured to be inserted into an open end of the rod member 22. A stepped portion 110 adjacent the open end 100 provides a shoulder that defines a stop against further insertion of the clutch housing 94 into the end of the rod member 22. The fit between the outer surface of the clutch housing 94 and the inner surface of the tubular rod member 22 can be a press fit such that the clutch housing cannot rotate relative to the rod member 22. In other words, rotation of the rod member 22 will cause corresponding co-rotation of the clutch housing 94. In other embodiments, the clutch housing 94 can be fixed to the rod member 22 with adhesives, by welding, or via a key or other anti-rotation feature so that the rod member 22 and the clutch housing 94 will rotate together as a unit.

The clutch mechanism 66 further includes first and second clutch plates 112 and 116, respectively, and a biasing member 120 in the form of a compression spring. The illustrated clutch plates 112 and 116 are made from plastic (e.g., nylon), but other materials can also be used. The first clutch plate 112 includes a body 124 having a threaded bore 128 extending therethrough. The threaded bore 128 receives the threaded rod 82 of the foot assembly 70 for relative rotation. The threaded bore 128 has either right-hand threads or left-hand threads to match the threads of the respective threaded rod 82, depending the end of the rod assembly 10.

The body 124 of the first clutch plate 112 further includes a first end 132 that is configured to extend out of the clutch housing 94 and can engage the mounting foot 74 when the rod assembly 10 is in its fully retracted position. In the illustrated embodiment, the first end 132 has a generally circular outer diameter that is substantially the same as the outer diameter of the open end 100 of the clutch housing 94. A plurality of projections 136 extend from the first end 132 for abutting engagement with the mounting foot 74.

The body 124 of the first clutch plate 112 also includes a second end 140 that includes teeth 144, which will be described further below. An intermediate portion 148 is defined between the first and second ends 132 and 140. The intermediate portion 148 is sized and configured with an outer surface that is contoured to conform with an inner surface of the clutch housing 94 so that the first clutch plate 112 can be positioned in the clutch housing 94 with the ability to rotate relative to the clutch housing 94, while being substantially prevented from moving axially (i.e., translating) relative to the clutch housing 94. While the illustrated intermediate portion 148 includes a stepped outer surface to correspond to the stepped inner surface of the clutch housing 94, other configurations that permit rotation and prevent axial translation can be substituted. When installed in the clutch housing 94, the intermediate portion 148 and the second end 140 of the first clutch plate 112 are housed inside the clutch housing 94, while the first end 132 extends from the open end 100 of the clutch housing 94.

The second clutch plate 116 is positioned in the clutch housing 94 closer to the closed end 104 than the first clutch plate 112. The second clutch plate 116 includes a body 152 having a bore 156 sized to provide clearance hole for the threaded rod 82, which extends therethrough. A first end 160 of the second clutch plate 116 abuts the compression spring 120, and a second end 164 of the second clutch plate 116 includes teeth 168 sized and configured to mate with the teeth 144 of the first clutch plate 112 to form an intermeshing tooth arrangement. As will be discussed further below, the spring 120 biases the second clutch plate 116 axially toward the first clutch plate 112 in order to keep the teeth 144 and 168 in intermeshing engagement. The orientation of the teeth 144 and 168 is also specific to which end of the rod assembly 10 the adjustment mechanism 58 is used. In other words, the orientation of the teeth 144 and 168 will be designed for opposite directions of rotation on opposite ends of the rod assembly 10.

The outer surface of the body 152 includes an anti-rotation feature that cooperates with a mating anti-rotation feature on the inner surface of the clutch housing 94 to allow axial translation but to prevent relative rotation between the clutch housing 94 and the second clutch plate 116. In the illustrated embodiment, the body 152 includes one or more axially-extending channels 172 (see FIG. 3-5) that mate with one or more axially-extending projections 176 (see FIG. 3-5) on the inner surface of the clutch housing 94 to substantially prevent relative rotation between the second clutch plate 116 and the clutch housing 94. Of course, the arrangement of the channels 172 and projections 176 could be reversed, or other known anti-rotation arrangements could be substituted.

Figure 4:
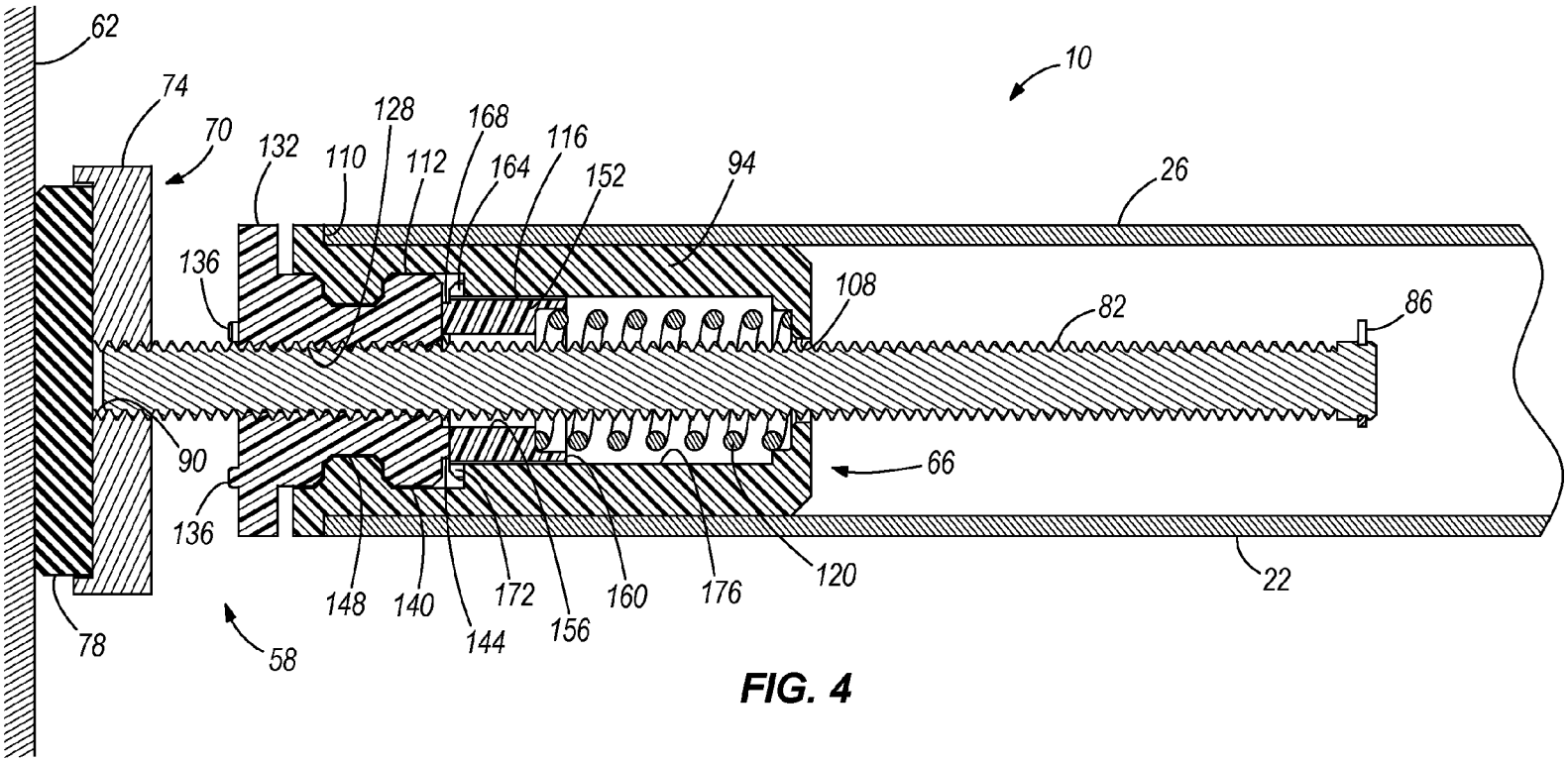
FIG. 4 is a section view of the adjustment mechanism of FIG. 3 illustrating the clutch mechanism in a first, torque-transmitting position.
Figure 5:
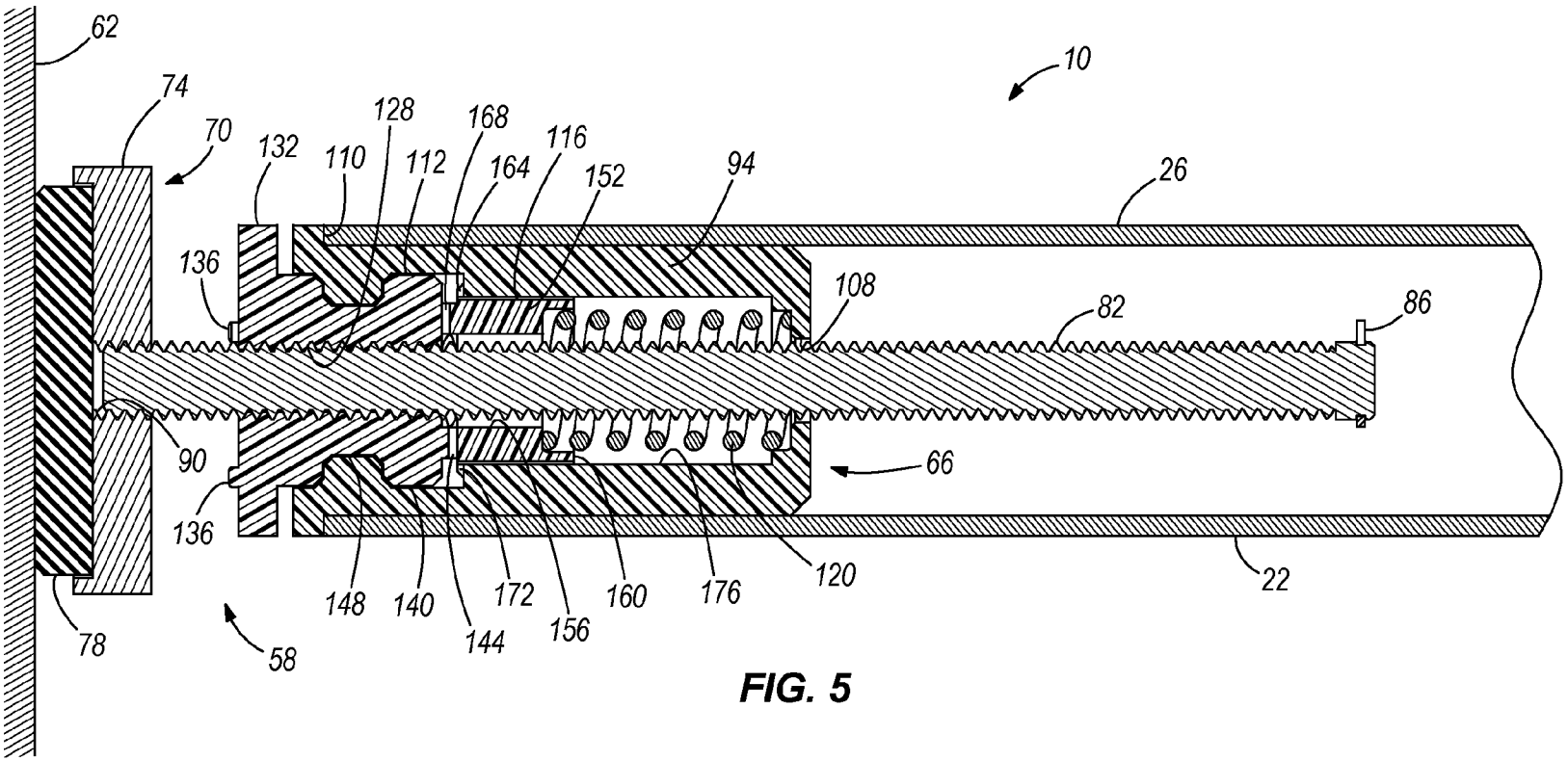
FIG. 5 is a section view of the adjustment mechanism of FIG. 3 illustrating the clutch mechanism in a second, overrunning position.

The adjustment mechanism 58 is assembled by positioning the clutch plates 112, 116, and the biasing member 120 in the clutch housing 94 as illustrated in FIGS. 4 and 5. The threaded rod 82 is received in the threaded bore 128 of the first clutch plate 112, and extends through the clearance bore 156 in the second clutch plate 116, and through the bore 108 in the open end 104 of the clutch housing 94. This couples the foot assembly 70 to the clutch mechanism 66. The snap ring 86 is placed on the end of the threaded rod 82 to prevent the threaded rod 82, and therefore the foot assembly 70, from being removed from the clutch mechanism 66 during operation, thereby defining a maximum extension length of the rod assembly 10.

Each assembled adjustment mechanism 58 can then be inserted into a respective end of the rod member 22 by pressing the clutch housing 94 into the end of the rod member 22 as described above. Again, the clutch housing 94 should be secured to the rod member 22 such that rotation of the rod member 22 causes co-rotation of the clutch housing 94.

In operation, a user or installer can assemble the rod halves 26 as discussed above (if the rod member 22 is a multi-piece rod member). Next, the rod assembly 10 can be installed into the correct position in the opening of the shower enclosure 14 by aligning the pressure pads 78 between the opposing support surfaces 62. The respective mounting feet 74 can be rotated manually in the appropriate direction (depending on the thread direction) to extend the threaded rod 82 from the adjustment mechanism 58 in an outward direction, away from the rod member 22 until the pressure pads 78 lightly contact the respective mounting surfaces 62. Upon contact, the friction between the support surface 62 and the pressure pad 78 will allow the user to rotate the rod member 22 about its longitudinal axis in a first, extension direction that will further extend the mounting feet 74 at both ends of the rod assembly 10 from the rod member 22.

With reference to FIG. 4, as the user rotates the rod member 22 about its longitudinal axis, the clutch housing 94 also rotates with the rod member 22. Because the second clutch plate 116 cannot rotate relative to the clutch housing 94 (due to the engagement between the channels 172 and projections 176) the second clutch plate 116 rotates with the clutch housing 94. The biasing member 120 biases the teeth 168 of the second clutch plate 116 into engagement with the teeth 144 of the first clutch plate 112. The teeth 144 and 168 have mating ramped surfaces 180 (see FIG. 3) configured to transmit torque from the second clutch plate 116 to the first clutch plate 112 as the user rotates the rod member 22 in the first, extension direction, provided that torque experienced between the first and second clutch plates 112, 116 is a first torque having a magnitude less than a magnitude that will cause the clutch mechanism 66 to overrun and prevent over-extension of the rod assembly 10. Such a condition will be described below.

As the user first rotates the rod member 22, the torque transmission from the second clutch plate 116 to the first clutch plate 112 causes the first clutch plate 112 to rotate with the clutch housing 94. Since the first clutch plate 112 cannot translate relative to the clutch housing 94, the rotation of the first clutch plate causes the threaded rod 82 to extend from the threaded bore 128 such that the mounting foot 74 and pressure pad 78 move away from the first end 132 of the first clutch plate 112 and toward the support surface 62. As the pressure pad 78 moves toward the support surface 62, the rod assembly 10 achieves a first length that exerts a first compressive force on the support surface 62.

Upon continued rotation of the rod member 22 by the user, the rod assembly 10 will extend further, thereby increasing the compressive force applied to the support surface 62 by the pressure pad 78. Before the rod assembly 10 reaches a second length that would create a second compressive force on the support surface 62 greater than the first compressive force, and potentially damaging to the support surface 62, the clutch mechanism 66 prevents further extension or over-extension of the rod assembly 10.

Specifically, and with reference to FIG. 5, as the user attempts to extend the rod assembly 10 to the second length by continuing to rotate the rod member 22, and therefore the second clutch plate 116, in the first direction, the torque input by the user will increase (due to the increased reaction force caused by the compression force on the foot assembly 70) to a second torque magnitude. The spring 120 is selected (i.e., sized and configured) to have a spring rate suited to permit overrunning of the clutch mechanism 66 at the desired second torque magnitude (i.e., to set the second torque magnitude). The illustrated spring 120 is made of steel, but other materials can be used as desired. As the torque of the second magnitude is applied by the user, the second clutch plate 116 moves axially away from the first clutch plate 112, overcoming the bias of the spring 120, due to the ramped surfaces 180 of the teeth 168 of the second clutch plate 116 sliding up the ramped surfaces 180 of the teeth 144 of the first clutch plate 112. This results in slipping or overrunning of the teeth 144, 168, and therefore the clutch mechanism 66, thereby preventing torque transmission between the clutch plates 112, 116. The first clutch plate 112 will not rotate with the housing 94. The user will be able to feel the slipping, and will also hear a clicking noise created by the repeated axial movement of the second clutch plate 116 against the first clutch plate 112 (from the position shown in FIG. 5 back to the position shown in FIG. 4) caused by the biasing force of the spring 120.

The spring 120 is selected to allow the adjustment mechanism 58 to be used to extend the rod assembly 10 sufficiently to support the rod assembly 10 and the depending curtain or curtains between the support surfaces 62, but to also prevent over-extension of the rod assembly 10 that could lead to damaging the support surfaces 62. Additionally, the ramped surfaces 180 of the teeth 144 and 168 can be configured (e.g., the slope can be varied) as desired to work in conjunction with the selected biasing member 120 to achieve the desired overrunning, second torque set-point.

Figure 3:
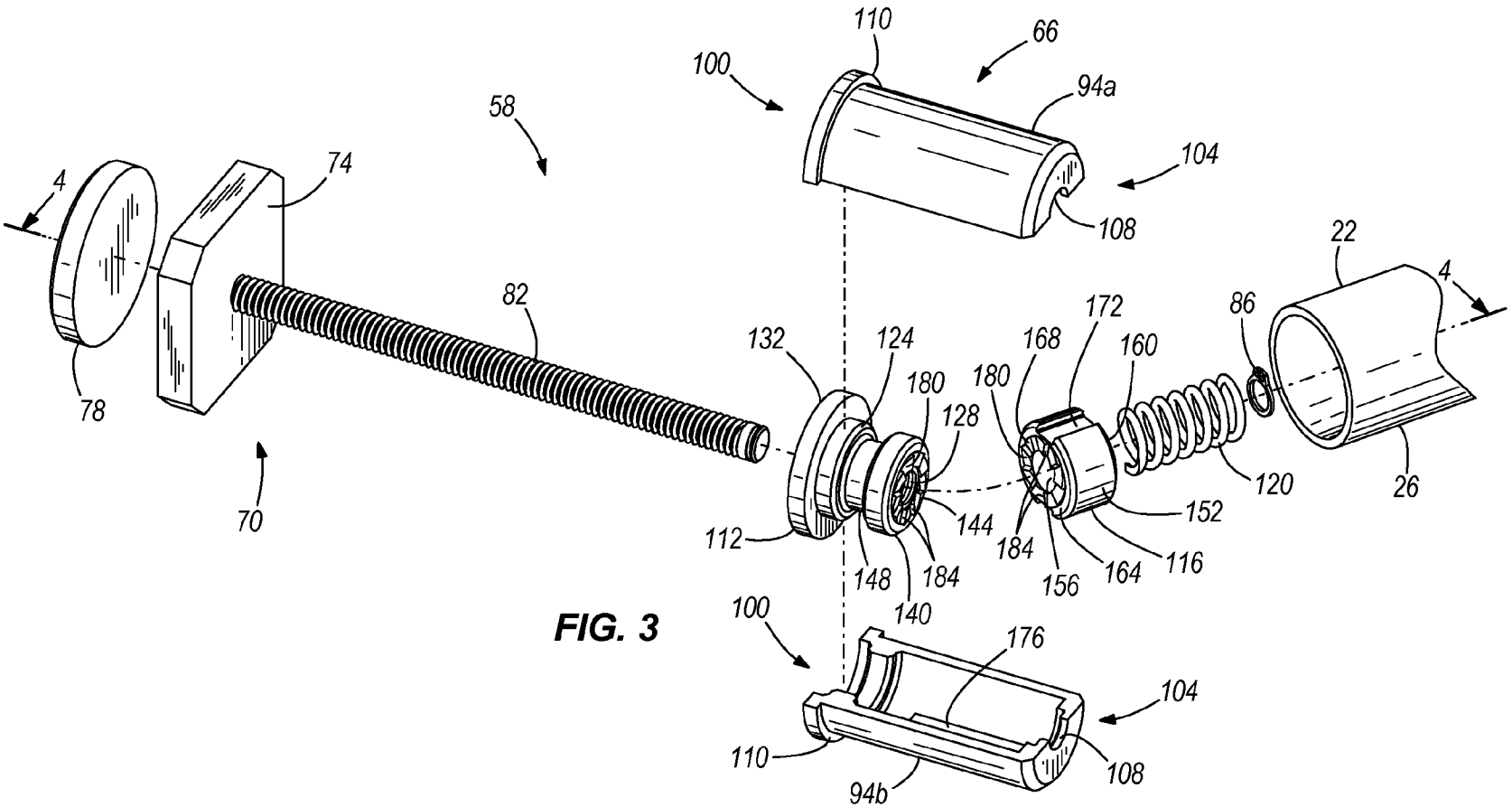
FIG. 3 is an enlarged exploded view of an adjustment mechanism of the adjustable curtain rod assembly of FIG. 1.

To retract or shorten the length of the rod assembly 10 in order to remove it from between the support surfaces 62, the user rotates the rod member 22, and therefore the second clutch plate 116, in a second direction opposite the first direction (i.e., a third torque). As seen in FIG. 3, the teeth 144 and 168 include mating non-ramped surfaces 184. With this arrangement, rotation of the second clutch plate 116 in the second direction will result in torque transmission to the first clutch plate 112 in the second direction, thereby retracting the threaded rod 82, the foot member 74, and the pressure pad 78 toward the rod member 22 and away from the support surface 62.

Figure 5A:
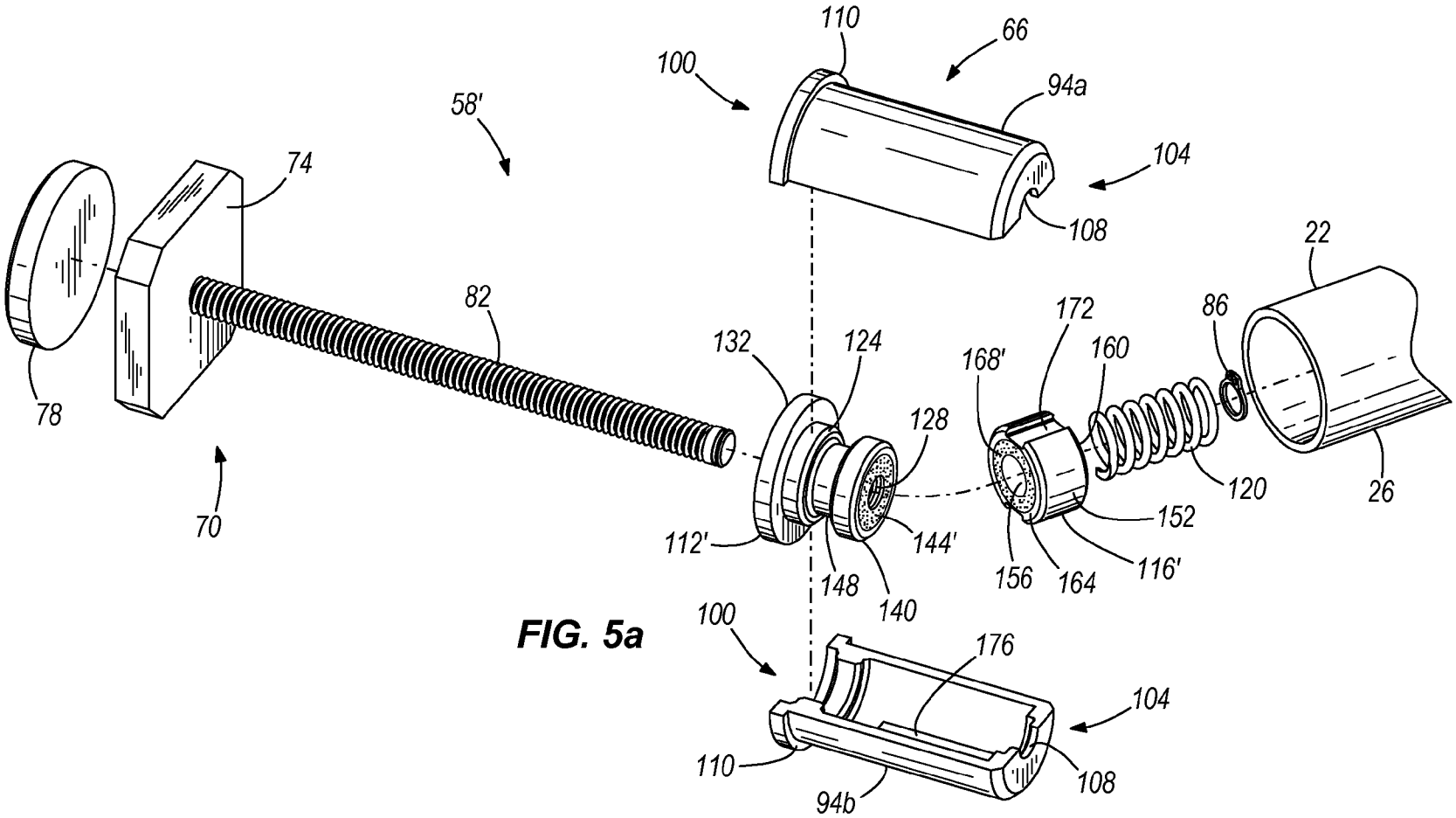
FIG. 5*a* is an enlarged exploded view of an alternative adjustment mechanism with modified clutch plates.

Various modifications to the illustrated adjustment mechanism 58 can be made without departing from the scope of the present invention. For example, FIG. 5*a* illustrates an adjustment mechanism 58' similar to the adjustment mechanism 58, with like parts given like reference numerals. In the adjustment mechanism 58', the teeth 144 and 168 are replaced by friction surfaces 144' and 168'. The engagement of the friction surfaces 144' and 168' operates in a manner similar to the intermeshing teeth 144 and 168 to transmit torque between the clutch plates 112', 116'.

Figure 5B:
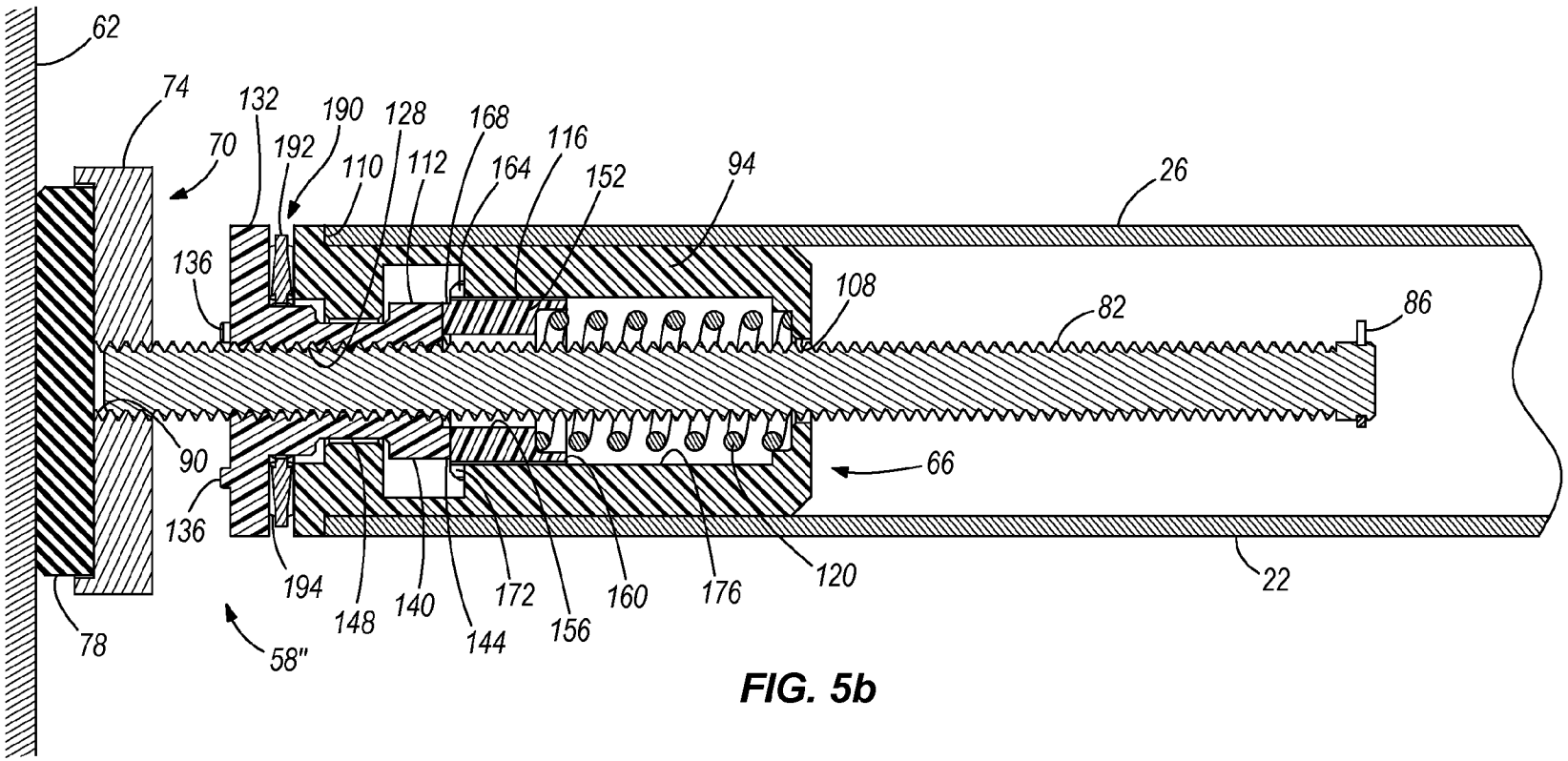
FIG. 5*b* is a section view of yet another alternative adjustment mechanism including a thrust bearing.

FIG. 5*b* illustrates another modification to the adjustment mechanism 58, in which a thrust bearing 190 is added to define an adjustment mechanism 58". Like parts have been given like reference numerals. The thrust bearing 190 is shown positioned between the first end 132 of the first clutch plate 112 and the end of the clutch housing 94 to help reduce friction between the first clutch plate 112 and the clutch housing 94 that may occur during operation of the adjustment mechanism 58". The illustrated thrust bearing 190 includes a retainer 192 and a plurality of rolling elements 194 (e.g., needle rollers, cylindrical rollers, balls, etc.). Of course other designs for the thrust bearing 190 can also be substituted. Additionally, the thrust bearing 190 can be moved to different locations within the adjustment mechanism 58", or multiple thrust bearings 190 can be incorporated.

Figure 6:
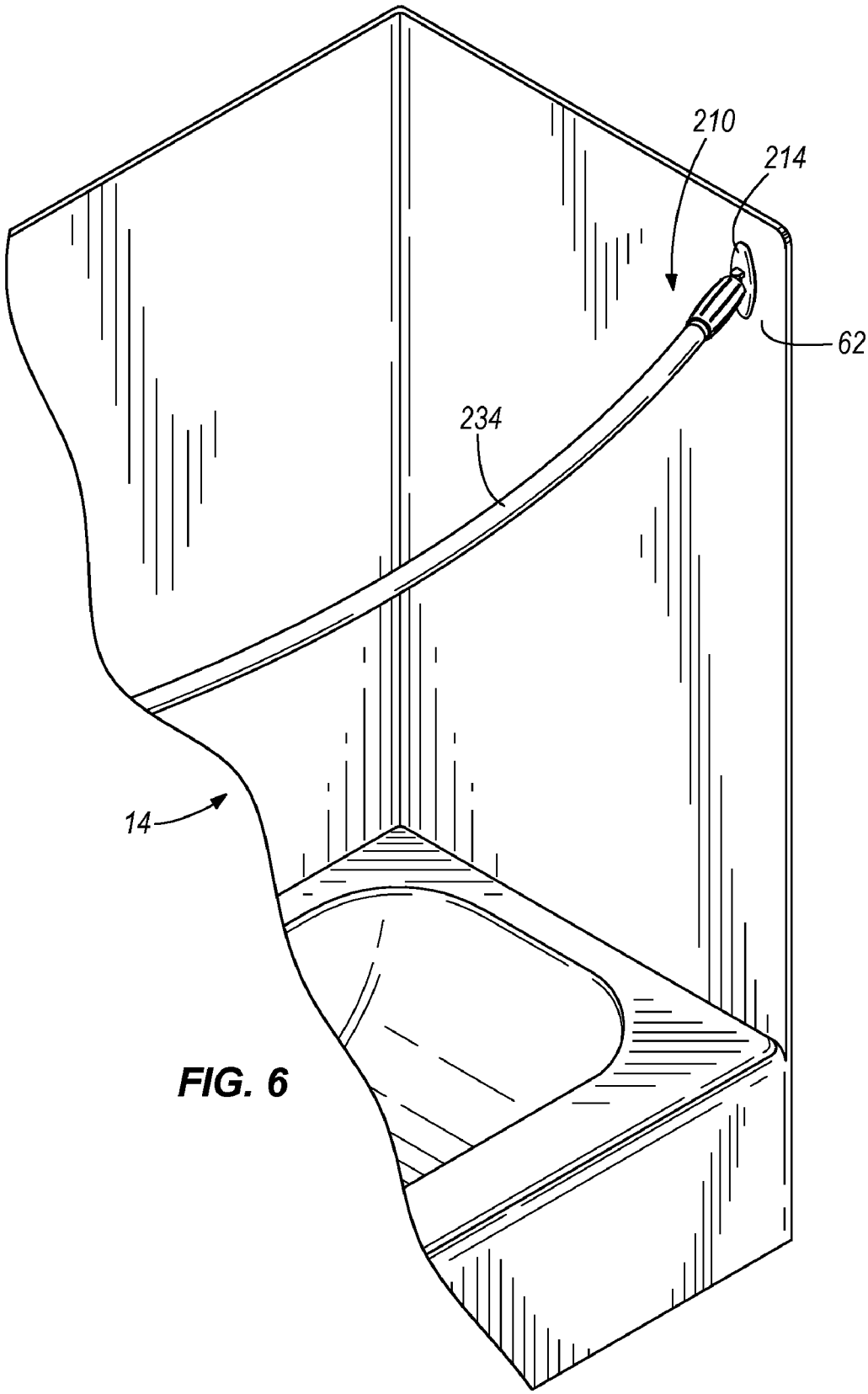
FIG. 6 is a partial perspective view of an adjustable curtain rod assembly that is a second embodiment of the invention mounted in a shower enclosure.
Figure 7:
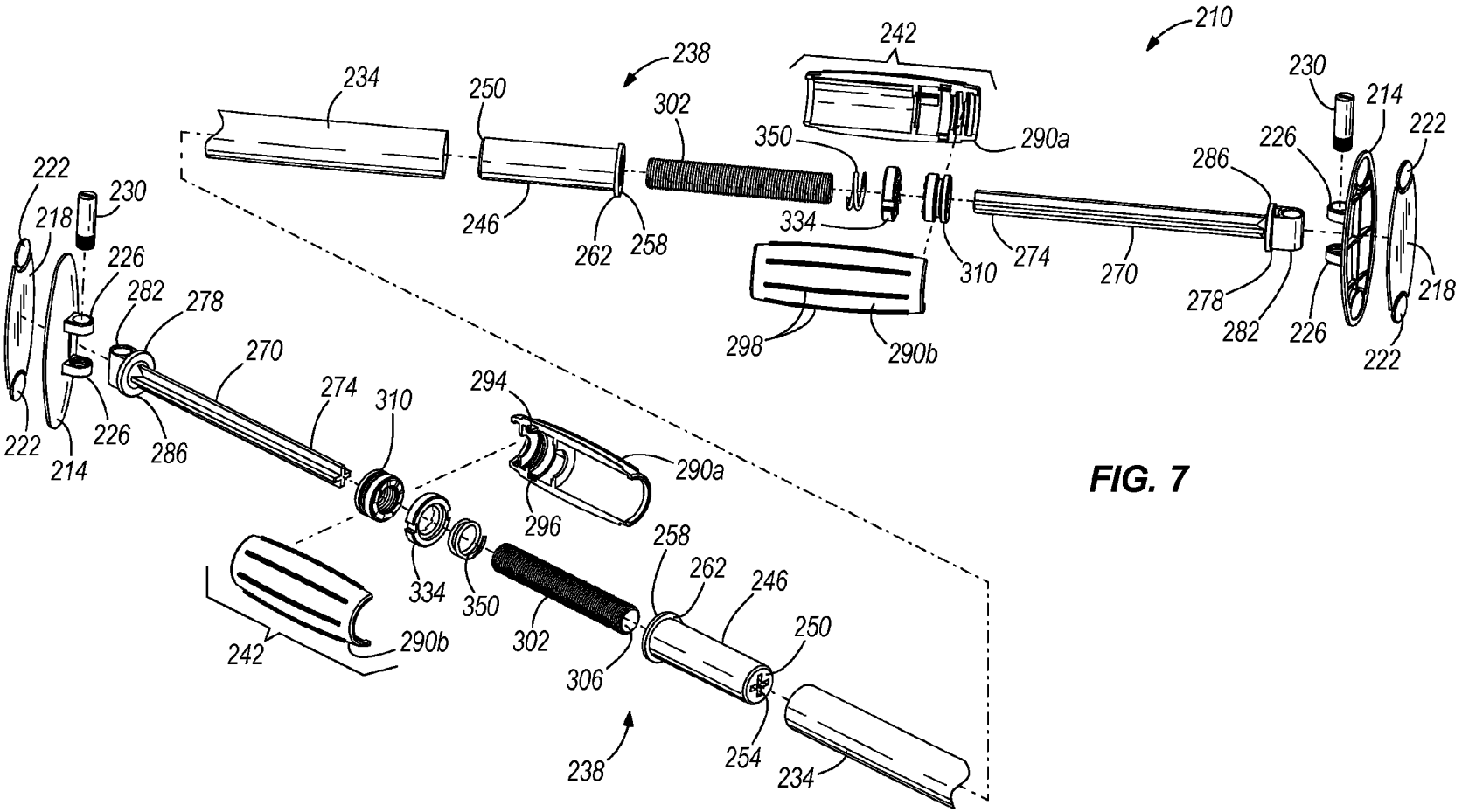
FIG. 7 is an exploded view of the adjustable curtain rod assembly of FIG. 6.

FIGS. 6-10 illustrate a second embodiment of an adjustable curtain rod assembly 210 according to the invention. The rod assembly 210 is a curved or arcuate rod assembly, as opposed to the straight rod assembly 10 of FIGS. 1-5. Curved rod assemblies provide a different aesthetic appeal. As used herein and in the appended claims, the terms "curved" and "arcuate" do not imply any particular curvature or that the rod assembly must have a constant curvature. Rather, as seen in FIGS. 6 and 7, end portions of the rod assembly 210 have a substantially straight segment.

With reference to FIGS. 6-10, wall plates or mounting plates 214 are configured to be mounted on the support surfaces 62. The relatively large footprint of the wall plates 214 helps distribute the compressive loading over a larger portion of the support surfaces 62, thereby minimizing the risk of damage to the support surfaces 62 during installation of the rod assembly 210. The wall plates 214 can be made from plastic (e.g., nylon) or other suitable materials. The wall plates 214 include a resilient pad 218 (e.g., rubber) for engaging the mounting surface 62. Pressure-sensitive adhesive patches 222 are also secured to the same side of the wall plate 214 as the resilient pad 218 to secure the wall plate 214 to the support surface 62 without the need for more permanent conventional fasteners (e.g., screws). The opposite side of the wall plate 214 includes a receiving structure in the form of two fastener-receiving members 226 configured to receive a fastener 230 that secures the rod assembly 210 to the wall plate 214, and therefore the support surface 62. Other securement arrangements for securing the rod assembly 210 to the wall plate 214 can be substituted for the illustrated arrangement.

The rod assembly 210 includes a curved rod member 234 made of low carbon steel, stainless steel, aluminum, or other suitable material. As with the rod member 22, the outer diameter of the rod member 234 is substantially constant to facilitate sliding of a hookless curtain or of conventional curtain rings along the length of the rod member 234.

In the illustrated embodiment, the rod assembly 210 includes adjustment mechanisms 238 coupled to both ends of the rod member 234, however, in other embodiments only a single adjustment mechanism could be used at one end of the rod member 234. The adjustment mechanism 238 operates in a similar manner to the adjustment mechanism 58 of the first embodiment, and includes a clutch mechanism 242. Unlike the rod member 22, the curved rod member 234 cannot be rotated to create the torque needed to extend and retract the rod assembly 210 because the orientation of the arcuate rod member 234 must be maintained constant for the desired aesthetic effect of the arcuate rod member 234 relative to the shower or bath enclosure 14 (i.e., bowed outwardly to provide more space to the enclosed area). Therefore, the adjustment mechanism 238 has a different design than the adjustment mechanism 58.

The adjustment mechanisms 238 are substantially the same with the exception of the orientation of certain components (e.g., threads, clutch teeth, etc.) depending upon which end of the rod assembly 210 they occupy, and thus, what directions of rotation they undergo to achieve extension and retraction of the rod assembly 210. In that regard, only one adjustment mechanism 238 will be discussed in detail, with the orientation-specific components being noted.

The adjustment mechanism 238 includes a threaded rod insert 246 sized to be secured (e.g., press fit and/or adhesively secured) into the end of the rod member 234. The illustrated rod insert 246 is plastic (e.g., nylon), and is generally cylindrical and cup-shaped with a first end 250 having a cross-shaped opening 254. A second end 258 includes a flange 262 that defines a shoulder acting as an insertion stop when the insert 246 is inserted into the rod member 234. A threaded bore 266 (see FIGS. 9 and 10) extends from the first end 250 to the second end 258. The threaded bore 266 includes right-hand or left-hand threads depending on which end of the rod assembly 210 the insert 246 is positioned.

The adjustment mechanism 238 further includes a mounting shaft 270 having a first end 274 with a cross-shaped cross-section corresponding to the cross-shaped opening 254 of the insert 246. A second end 278 includes a fastener-receiving member 282 configured to cooperate with the two fastener-receiving members 226 of the wall plate 214 and the fastener 230 to couple the mounting shaft 270 to the wall plate 214. A generally circular diameter disk portion 286 is formed near the second end 278, the purpose of which will be discussed below. The illustrated mounting shaft 270 is made of plastic (e.g., nylon), but could also be made of other suitable materials. Furthermore, the cross-shaped cross-sectional shape of the first end 274 and the corresponding cross-shaped opening 254 could be varied as desired, provided geometry is selected that permits axial translation of the mounting shaft 270 relative to the insert 246, while relative rotation of those components is prevented.

The clutch mechanism 242 of the adjustment mechanism 238 will now be described. As mentioned above, due to the inability of the curved rod member 234 to be rotated to extend and retract the rod assembly 210, the clutch mechanism 242 includes a rotatable handle 290, that in the illustrated embodiment, is formed of two plastic (e.g., nylon), handle halves 290*a* and 290*b*. The halves 290*a*, 290*b* are assembled together, around other components of the adjustment mechanism 238 and is rotatable relative to the rod member 234, as will be described further below. Projections 294 and mating recesses 296 (see FIG. 8), or other securing features, can be used to facilitate securing the housing halves 290*a*, 290*b* together. Adhesives, snap-fit arrangements, welding, and other suitable securing techniques can also be used. The outer surface of the handle 290 includes ribs 298 or other suitable features to facilitate a user grasping and rotating the handle 290.

A hollow, threaded rod 302 is threaded on its outer surface with left-hand or right-hand threads depending on the end of the rod assembly 210 with which it is used. The threads are sized and configured to mate with the threads of the threaded bore 266 of the insert 246, for receipt therein. A smooth bore 306 extends through the rod 302 and is sized to permit the mounting shaft 270, and specifically the first end 274 of the mounting shaft 270 to pass therethrough with clearance. The illustrated threaded rod 302 is made of plastic (e.g., nylon), but could also be made of metal or other suitable materials.

A first clutch plate 310 is non-rotatably secured to one end of the threaded rod 302. In the illustrated embodiment, the first clutch plate 310 includes a body 314 having a threaded bore 318 corresponding to the threads of the rod 302. Adhesive is used to fix the first clutch plate 310 to the rod 302 for rotation therewith. The body 314 has a first end 322, a second end 326, and an intermediate portion 330 between the first and second ends. The second end 326 includes teeth 328.

In the illustrated embodiment, the first end 322 has a generally circular outer diameter that corresponds to an inner surface of the handle 290, and the intermediate portion 330 is sized and configured with an outer surface that is contoured to conform with the inner surface of the handle 290 so that the first clutch plate 310 can be positioned in the handle 290 with the ability to rotate relative to the handle 290, while being substantially prevented from moving axially (i.e., translating) relative to the handle 290. While the illustrated intermediate portion 330 includes a stepped outer surface to correspond to the stepped inner surface of the handle 290, other configurations that permit rotation and prevent axial translation can be substituted. When installed in the handle 290, the entire first clutch plate 310 is housed inside the handle 290.

A second clutch plate 334 is positioned in the handle 290 closer to the rod member 234 than the first clutch plate 310. The second clutch plate 334 includes a body 338 having a bore 342 sized to provide a clearance hole for the threaded rod 302, which extends therethrough. A first end 346 of the second clutch plate 334 abuts a biasing member 350 (e.g., a compression spring) seated within the handle 290, and a second end 354 of the second clutch plate 334 includes teeth 358 sized and configured to mate with the teeth 328 of the first clutch plate 310 to form an intermeshing tooth arrangement. As will be discussed further below, the spring 350 biases the second clutch plate 334 axially toward the first clutch plate 310 in order to keep the teeth 328 and 358 in intermeshing engagement. The orientation of the teeth 328 and 358 is also specific to which end of the rod assembly 210 the adjustment mechanism 238 is used. In other words, the orientation of the teeth 328 and 358 will be designed for opposite directions of rotation on opposite ends of the rod assembly 210. As mentioned above, the teeth 328 and 358 can also be replaced by friction surfaces in a manner similar to that shown in FIG. 5*a*.

The outer surface of the body 338 includes an anti-rotation feature that cooperates with a mating anti-rotation feature on the inner surface of the handle 290 that allows axial translation but prevents relative rotation between the handle 290 and the second clutch plate 334. In the illustrated embodiment, the body 338 includes one or more axially-extending channels 362 (see FIG. 8) that mate with one or more axially-extending projections 366 (see FIG. 8) on the inner surface of the handle 290 to substantially prevent relative rotation between the second clutch plate 334 and the handle 290. Of course, the arrangement of the channels 362 and projections 366 could be reversed, or other known anti-rotation arrangements could be substituted. The illustrated first and second clutch plates 310, 334 are made of plastic (e.g., nylon), but other suitable materials can be substituted.

Figure 9:
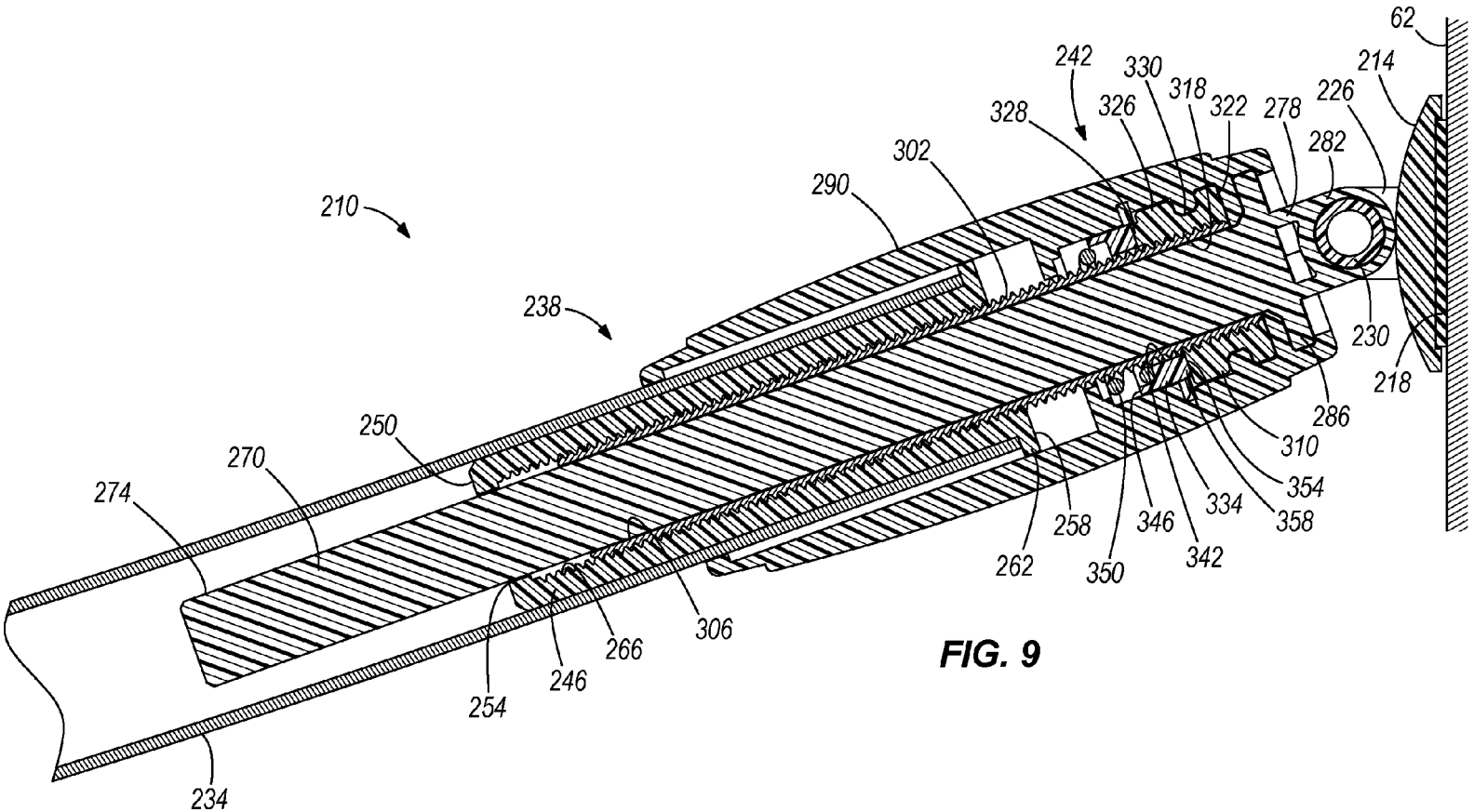
FIG. 9 is a section view of the adjustment mechanism of FIG. 8 illustrating the clutch mechanism in a first, torque-transmitting position.
Figure 10:
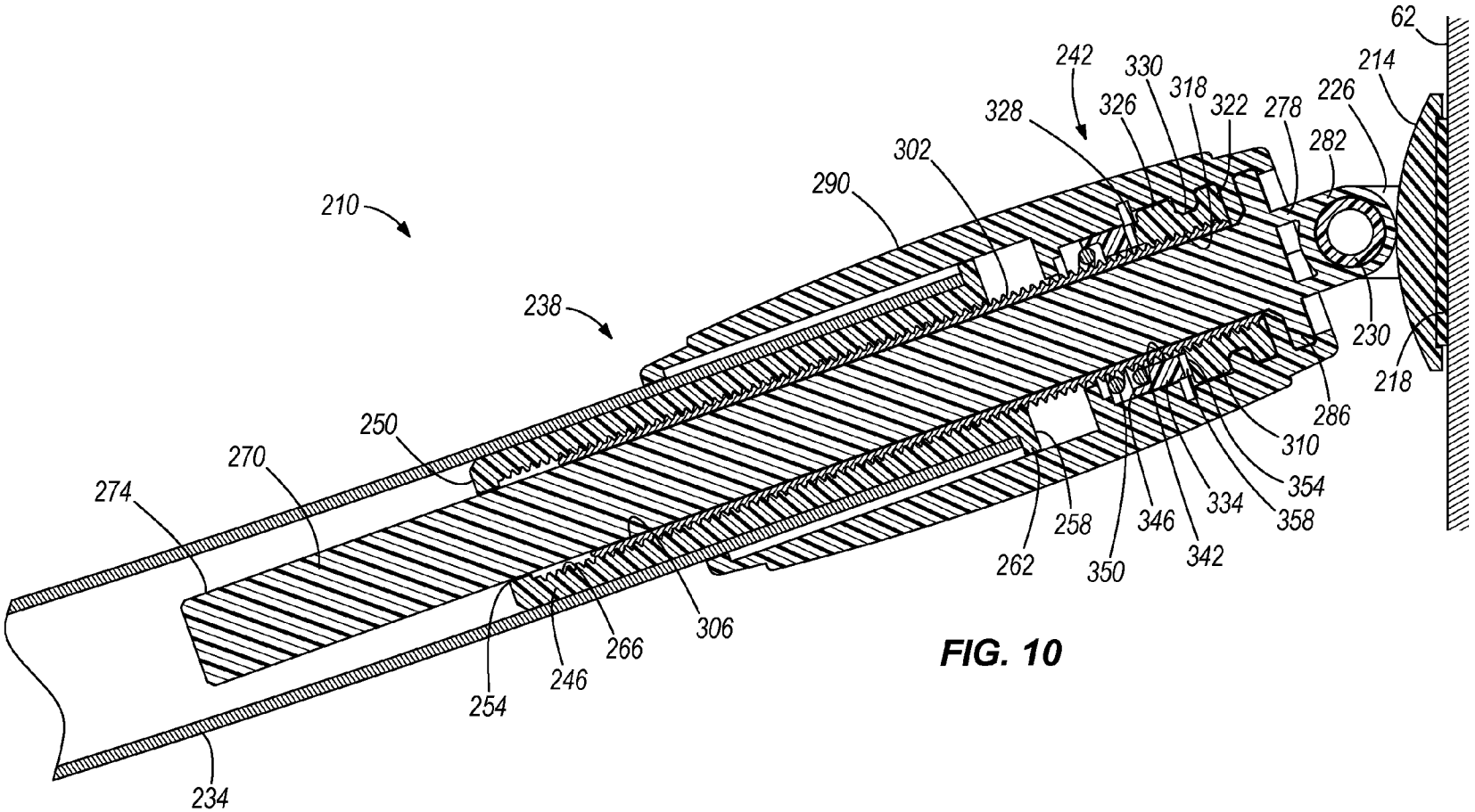
FIG. 10 is a section view of the adjustment mechanism of FIG. 8 illustrating the clutch mechanism in a second, overrunning position.
Figure 11:
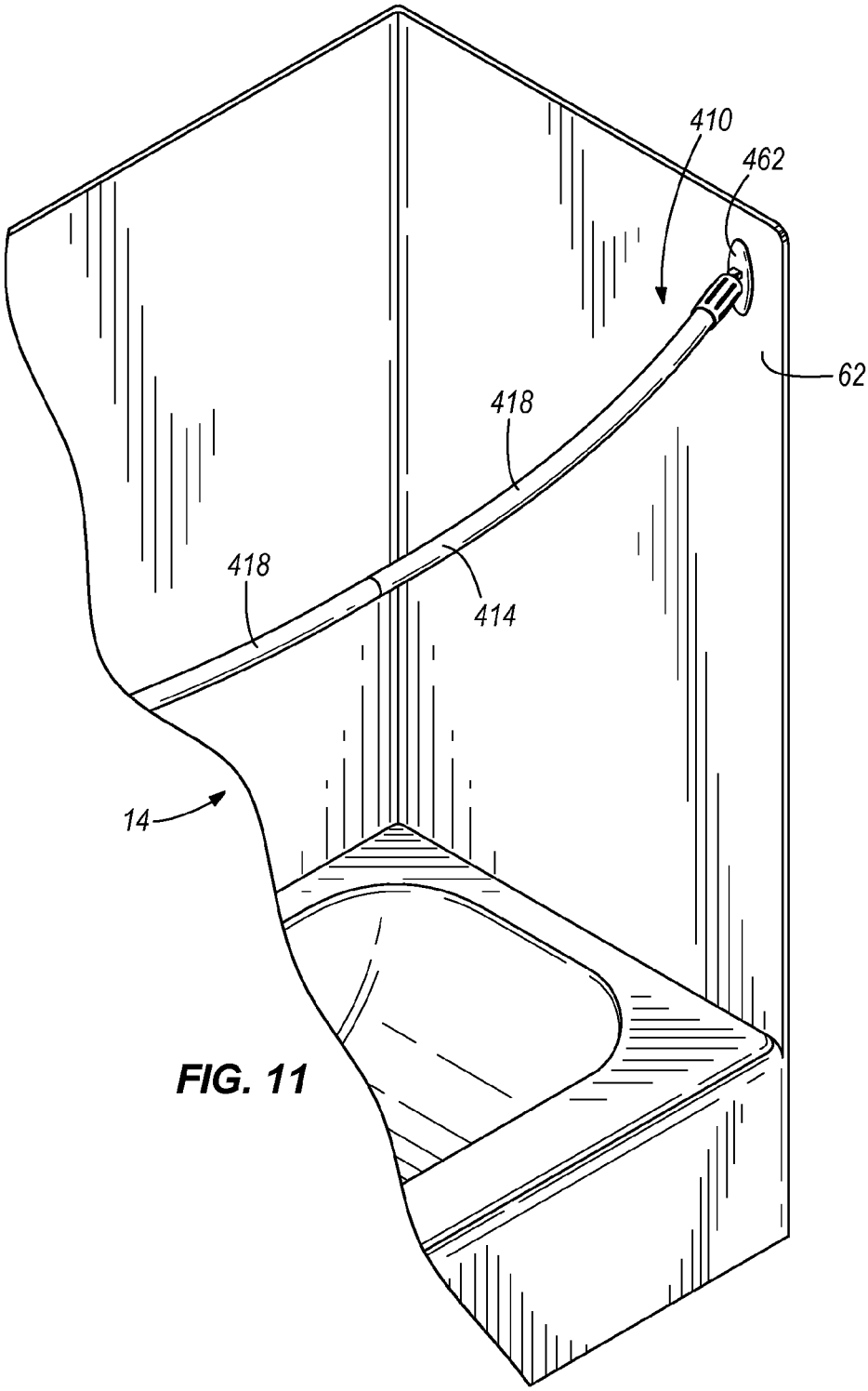
FIG. 11 is a partial perspective view of an adjustable curtain rod assembly that is a third embodiment of the invention mounted in a shower enclosure.

The adjustment mechanism 238 is assembled by positioning the clutch plates 310, 334, the threaded rod 302 and the biasing member 350 in the handle 290 as illustrated in FIGS. 9 and 10. The threaded rod 302 extends from the handle 290 and is received in the threaded bore 266 of the rod insert 246. The mounting shaft 270 extends through the threaded rod 302 and into the rod insert 246, with the cross-shaped first end 274 received in the cross-shaped opening 254.

In operation, a user or installer can install the rod assembly 210 into the correct position in the opening of the shower enclosure 14 by first mounting the wall plates 214 in the appropriate positions on the opposing mounting surfaces 62. Next, the mounting shafts 270 are inserted into the respective ends of the rod assembly 210 as discussed above, and the fasteners 230 are secured through the aligned fastener-receiving members 226 and 282. To add tension and fully secure the rod assembly 210 in place, the user rotates one or both of the handles 290 about its longitudinal axis in a first direction. Because the second clutch plate 334 cannot rotate relative to the handle 290 (due to the engagement between the channels 362 and projections 366) the second clutch plate 334 rotates with the handle 290. The biasing member 250 biases the teeth 358 of the second clutch plate 334 into engagement with the teeth 328 of the first clutch plate 310. The teeth 328 and 358 have mating ramped surfaces 370 (see FIG. 8—labeled only on the first clutch plate 310 but similar to the ramped surfaces 180 in FIG. 3 on the second clutch plate 334) configured to transmit torque from the second clutch plate 334 to the first clutch plate 310 as the user rotates the handle in the first, extension direction, provided that the torque experienced between the first and second clutch plates 310, 334 is a first torque having a magnitude less than a magnitude that will cause the clutch mechanism 242 to overrun and prevent over-extension of the rod assembly 210. Such a condition will be described below.

As the user first rotates the handle 290, the torque transmission from the second clutch plate 334 to the first clutch plate 310 causes the first clutch plate 310 to rotate with the handle 290. Since the first clutch plate 310 is fixedly secured to the threaded rod 302, and cannot translate relative to the handle 290, the rotation of the first clutch plate 310 causes the threaded rod 302 to rotate and extend from the threaded bore 266 of the rod insert 246 toward the wall plate 214. In actuality, since the mounting shaft 270 is fixed to the wall plate 214 via the fastener 230, the extension of the threaded rod 302 and the mounting shaft 270 from the rod insert 246 actually causes the rod insert 246 and the associated end of the rod member 234 to move away from the wall plate 214. The handle 290, the clutch plates 310, 334, and the spring 250 all translate toward the wall plate 214 such that the handle 290 abuts the disk portion 286 of the mounting shaft 270 and causes it to extend outwardly (translating without rotation) relative to the rod insert 246 in a direction toward the wall plate 214. From the outside, the user will only see the handle 290 translating along the rod member 234 toward the wall plate 214. However, such translation of the handle 290 will cause increased compressive force to be applied by the mounting shaft 270 onto the wall plate 214, and therefore onto the support surface 62. The rod assembly 210 thereby achieves a first length that exerts a first compressive force on the support surface 62.

Upon continued rotation of the handle 290 by the user, the rod assembly 210 will extend further, thereby increasing the compressive force applied to the support surface 62 by the mounting shaft 270. Before the rod assembly 210 reaches a second length that would create a second compressive force on the support surface 62 greater than the first compressive force, and potentially damaging to the support surface 62, the clutch mechanism 242 prevents further extension or over-extension of the rod assembly 210.

Specifically, and with reference to FIG. 10, as the user attempts to extend the rod assembly 210 to the second length by continuing to rotate the handle 290, and therefore the second clutch plate 334, in the first direction, the torque input by the user will increase (due to the increased reaction force caused by the compression force on the mounting shaft 270) to a second torque magnitude. The spring 250 is selected (i.e., sized and configured) to have a spring rate suited to permit overrunning of the clutch mechanism 242 at the desired second torque magnitude (i.e., to dictate the second torque set-point). The illustrated spring 250 is made of steel, but other materials can be used as desired. As the torque of the second magnitude is applied by the user, the second clutch plate 334 moves axially away from the first clutch plate 310, overcoming the bias of the spring 250, due to the ramped surfaces 370 of the teeth 358 of the second clutch plate 334 sliding up the ramped surfaces 370 of the teeth 328 of the first clutch plate 310. This results in slipping or overrunning of the teeth 328, 358, and therefore the clutch mechanism 242, thereby preventing torque transmission between the clutch plates 310, 334. The first clutch plate 310 will not rotate with the handle 290. The user will be able to feel the slipping, and will also hear a clicking noise created by the repeated axial movement of the second clutch plate 334 against the first clutch plate 310 (from the position shown in FIG. 10 back to the position shown in FIG. 9) caused by the biasing force of the spring 250.

The spring 250 is selected to allow the adjustment mechanism 238 to be used to extend the rod assembly 210 sufficiently to support the rod assembly 210 and the depending curtain or curtains between the support surfaces 62, but to also prevent over-extension of the rod assembly 210 that could lead to damaging the support surfaces 62. Additionally, the ramped surfaces 370 of the teeth 328 and 358 can be configured (e.g., the slope can be varied) as desired to work in conjunction with the selected biasing member 250 to achieve the desired overrunning, second torque set-point.

Figure 8:
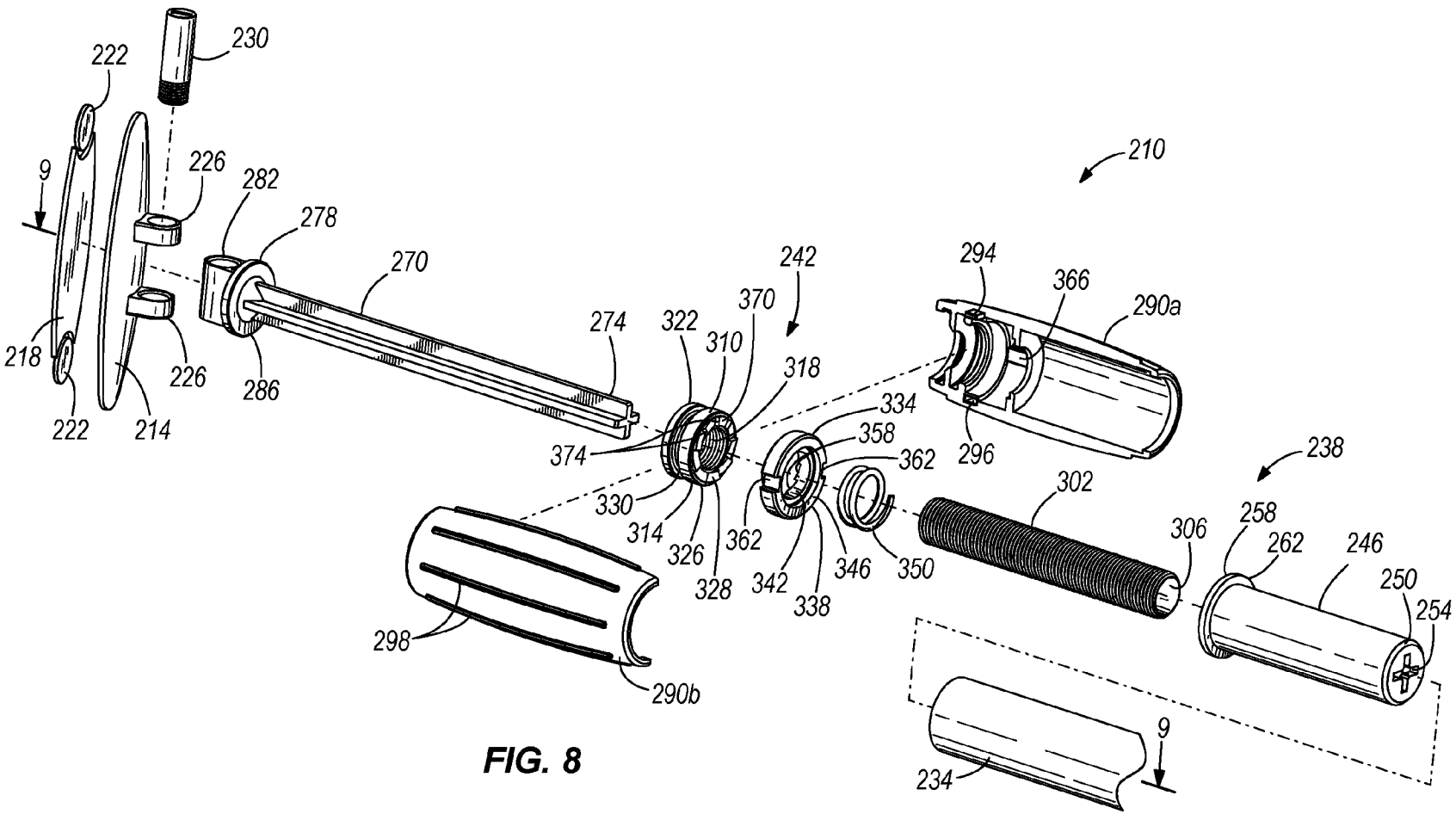
FIG. 8 is an enlarged exploded view of an adjustment mechanism of the adjustable curtain rod assembly of FIG. 6.

To retract or shorten the length of the rod assembly 210 in order to remove it from between the wall plates 214, the user rotates the handle 290, and therefore the second clutch plate 334, in a second direction opposite the first direction (i.e., a third torque). As seen in FIG. 8, the teeth 328 and 358 include mating non-ramped surfaces 374 (labeled only on the first clutch plate 310 but similar to the non-ramped surfaces 184 in FIG. 3 on the second clutch plate 334). With this arrangement, rotation of the second clutch plate 334 in the second direction will result in torque transmission to the first clutch plate 310 in the second direction, thereby retracting the threaded rod 302 and the handle 290 toward the rod member 234 and away from the support surface 62. The mounting shaft 270 will then be free to retract into the rod insert 246, allowing the rod insert 246 to move closer toward the disk portion 286 of the mounting shaft 270, thereby reducing the compressive force exerted by the handle 290, onto the mounting shaft 270, and onto the support surface 62 via the wall plate 214. The fasteners 230 can then be removed so the rod assembly 210 is free to be taken off the wall plates 214.

FIGS. 11-15 illustrate yet another embodiment of a curved or arcuate rod assembly 410 that is a third embodiment of the invention. The rod assembly 410 includes a rod member 414, which in the illustrated embodiment can be made from any of low carbon steel, stainless steel, or aluminum and includes two distinct tubular rod halves or rod members 418 interconnected together by a connector assembly 422. Having the rod member 414 formed from two rod halves 418 enables the rod assembly 410 to be packaged and handled more efficiently prior to installation.

Figure 12:
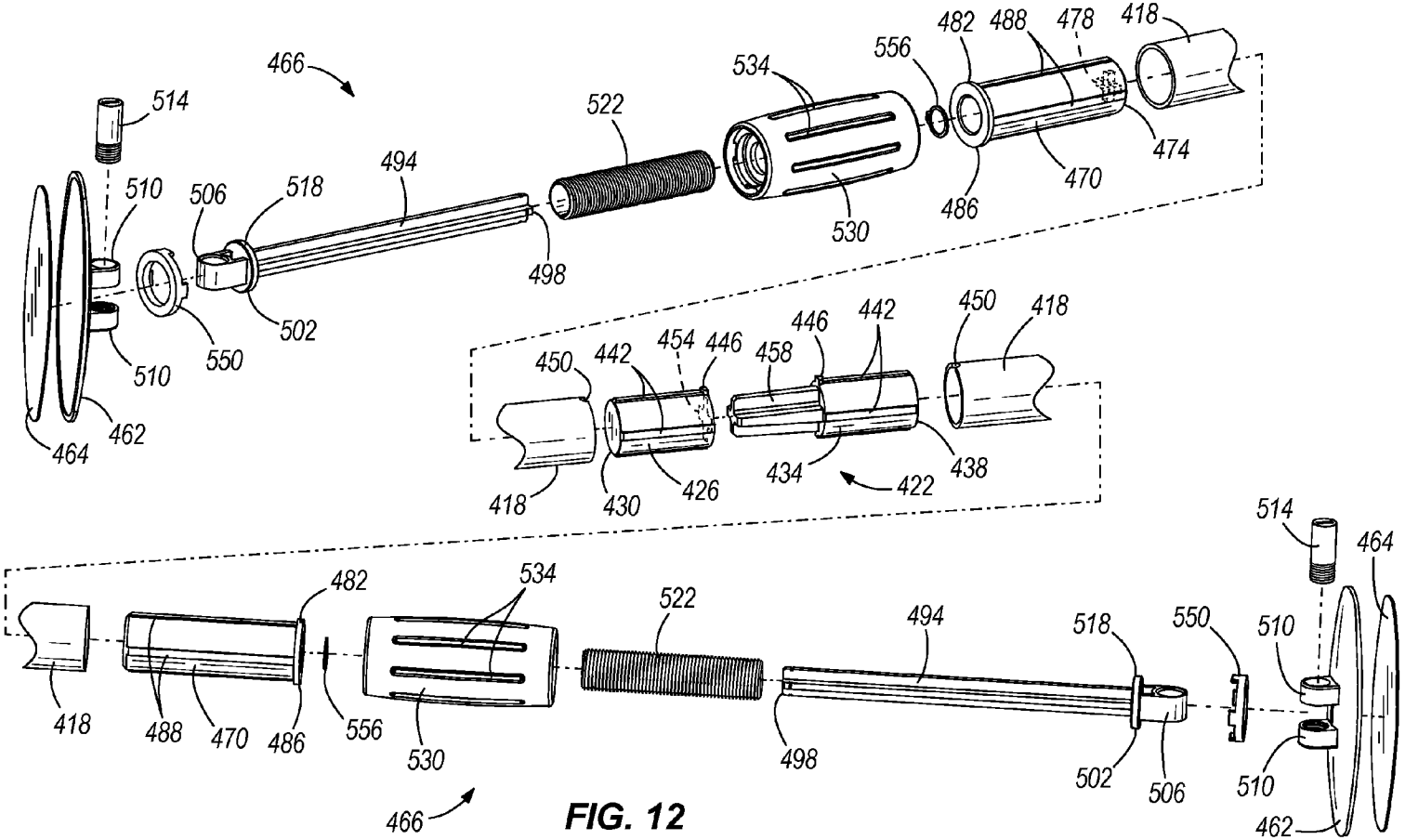
FIG. 12 is an exploded view of the adjustable curtain rod assembly of FIG. 11.
Figure 13:
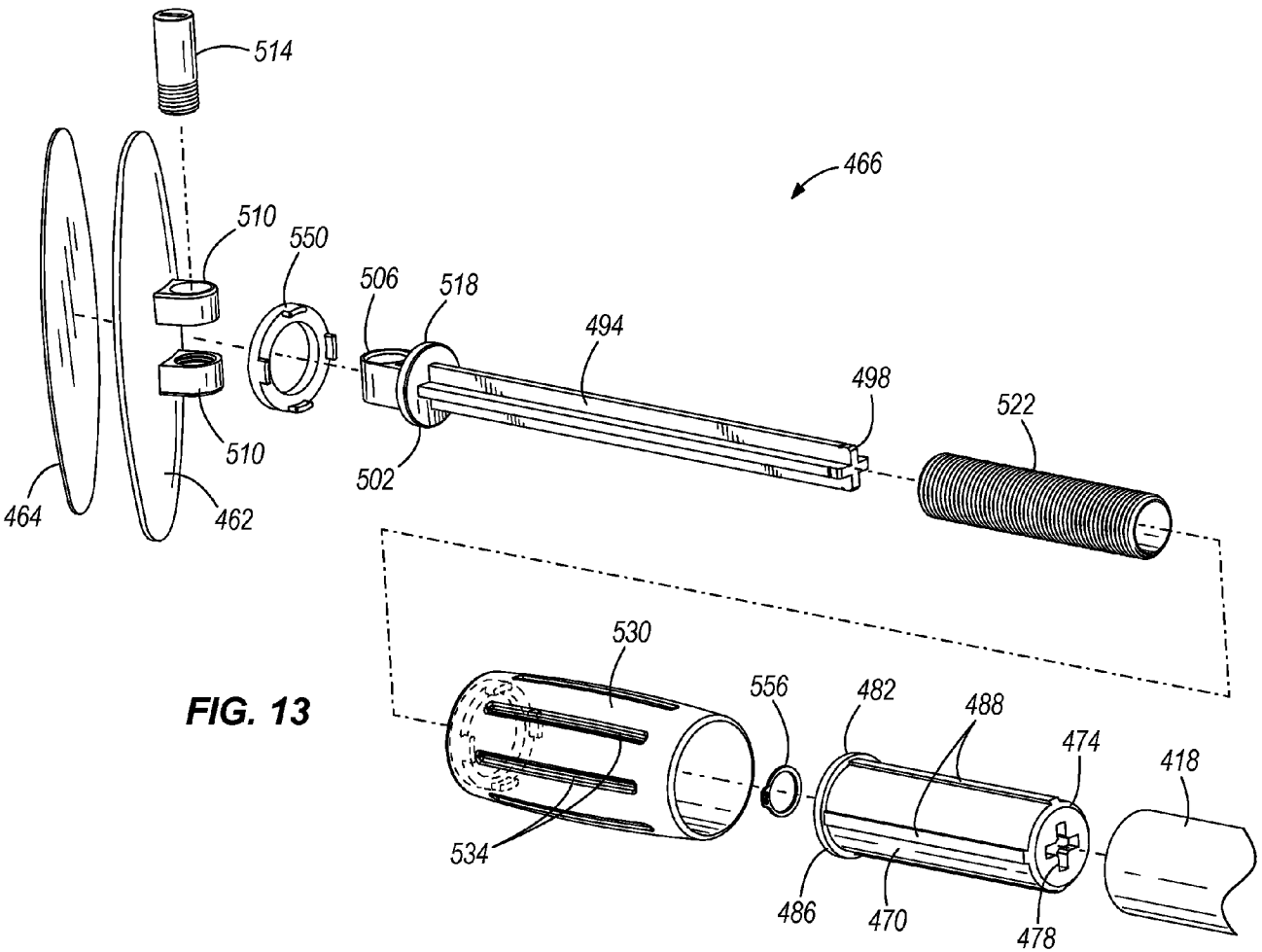
FIG. 13 is an enlarged exploded view of an adjustment mechanism of the adjustable curtain rod assembly of FIG. 11.

As shown in FIG. 12, the connector assembly 422 includes a female connector 426 having a first end 430 sized and configured to be secured (e.g., pressed) into an open end of one rod member 418, and a male connector 434 having a first end 438 sized and configured to be secured (e.g., pressed) into an open end of the other rod member 418. Each of the female and male connectors 426, 434 includes one or more ribs 442 on the outer surface and operable to secure the connectors 426, 434 into the respective rod member 418. Each connector 426, 434 further includes an alignment and anti-rotation projection 446 (illustrated as being adjacent one of the ribs 442) sized and configured to be received in a corresponding notch 450 in the respective rod members 418. The projections 446 and notches 450 cooperate to properly align the rod members 418 and connectors 426, 434 for assembly. In other embodiments, the projections 446 could be on the rod members 418 and the notches 450 could be on the connectors 426, 434.

The female connector 426 includes a cross-shaped bore 454 sized and configured to receive a tapering, cross-shaped end 458 of the male connector 434 such that when assembled, the connectors 426 and 434 cannot rotate relative to one another. The cooperating projections 446 and notches 450 also prevent the assembled connectors 426 and 434 from rotating relative to the rod members 418, thereby keeping the rod halves 418 properly oriented for the arcuate rod arrangement.

The illustrated connector assembly 422 is made from plastic (e.g., nylon), but other materials can also be used. In other embodiments, different securing and anti-rotation arrangements can be used in place of the illustrated cross-shaped engagement and the projection and notch arrangement. Also, other embodiments may include more than two distinct rod portions, and other materials can be used for the rod members 418.

The illustrated rod member 414, even when assembled from the two distinct rod halves 418, defines an outer diameter of a constant dimension. This enables and facilitates both the use of a hookless curtain or a curtain supported by curtain rings. More specifically, and unlike many conventional telescoping curtain rod assemblies made from two rod halves of differing outer diameters, the illustrated rod member 414 of the constant outer diameter contains no discontinuities (e.g., steps or other changes in outer diameter) along the length of the rod member 414. Such discontinuities can make sliding the curtain along the rod member difficult.

The rod assembly 410 includes wall plates or mounting plates 462 configured to be mounted on the support surfaces 62. The wall plates 462 are substantially the same as the wall plates 214 described above and will not be described again in detail. Pressure-sensitive adhesive pads 464 couple the wall plates 462 to the support surfaces 62. The relatively large footprint of the wall plates 462 helps distribute the compressive loading over a larger portion of the support surfaces 62, thereby minimizing the risk of damage to the support surfaces 62 during installation of the rod assembly 410. The angle at which the rod member 414 attaches to the mounting plates 462 is non-perpendicular, such that any compressive forces are not directed in a normal direction relative to the mounting surfaces 62.

In the illustrated embodiment, the rod assembly 410 includes adjustment mechanisms 466 coupled to both ends of the rod member 414, however, in other embodiments only a single adjustment mechanism could be used at one end of the rod member 414. The adjustment mechanism 466 operates in a similar manner to the adjustment mechanism 238 of the second embodiment, but does not include any clutch mechanism. Due to the arcuate rod's inherent ability to bow under compressive force created when installing and tightening the rod assembly 410 (depending upon the material used for the rod member 414), and the non-perpendicular orientation relative to the support surfaces 62, it may be acceptable to eliminate a clutch mechanism. Compressive forces generated in the rod assembly 410 are minimized by the fact that the direction of the force is not normal to the support surfaces 62, are relieved by the bowing of the rod member 414, and will not cause damage to the support surfaces 62.

The adjustment mechanisms 466 are substantially the same with the exception of the orientation of certain components (e.g., threads, etc.) depending upon which end of the rod assembly 410 they occupy, and thus, what directions of rotation they undergo to achieve extension and retraction of the rod assembly 410. In that regard, only one adjustment mechanism 466 will be discussed in detail.

The adjustment mechanism 466 includes a threaded rod insert 470 sized to be secured (e.g., press fit and/or adhesively secured) into the end of the rod member 414. The illustrated rod insert 470 is plastic (e.g., nylon), and is generally cylindrical and cup-shaped with a first end 474 having a cross-shaped opening 478. A second end 482 includes a flange 486 that defines a shoulder acting as an insertion stop when the insert 470 is inserted into the rod member 414. Ribs 488 can be provided on the outer surface of the insert 470 to facilitate securement within the rod member 414. A threaded bore 490 (see FIG. 14) extends from the first end 474 to the second end 482. The threaded bore 490 includes right-hand or left-hand threads depending on which end of the rod assembly 410 the insert 470 is positioned.

The adjustment mechanism 466 further includes a mounting shaft 494 having a first end 498 with a cross-shaped cross-section corresponding to the cross-shaped opening 478 of the insert 470. A second end 502 includes a fastener-receiving member 506 configured to cooperate with the two fastener-receiving members 510 of the wall plate 462 and the fastener 514 to couple the mounting shaft 494 to the wall plate 462. A generally circular diameter disk portion 518 is formed near the second end 502, the purpose of which will be discussed below. The illustrated mounting shaft 494 is made of plastic (e.g., nylon), but could also be made of other suitable materials. Furthermore, the cross-shaped cross-sectional shape of the first end 498 and the corresponding cross-shaped opening 478 could be varied as desired, provided geometry is selected that permits axial translation of the mounting shaft 494 relative to the insert 470, while relative rotation of those components is prevented.

A hollow, threaded rod 522 includes smooth bore 526 (see FIG. 14) that extends through the rod 522 and is sized to permit the mounting shaft 494, and specifically the first end 498 of the mounting shaft 494 to pass therethrough with clearance. The threaded rod 522 is threaded on its outer surface with left-hand or right-hand threads depending on the end of the rod assembly 410 with which it is used. The threads are sized and configured to mate with the threads of the threaded bore 490 of the insert 470, for receipt therein. The illustrated threaded rod 522 is made of plastic (e.g., nylon), but could also be made of metal or other suitable materials.

A rotatable handle 530, that in the illustrated embodiment is formed of a single plastic piece (e.g., nylon), is sized and configured to at least partially surround the insert 470, the mounting shaft 494, and the threaded rod 522. In other embodiments, the handle can be made of two halves assembled together as described above with respect to the handle 242. With the components assembled therein, the handle 530 is rotatable relative to the rod member 414, as will be described further below. The outer surface of the handle 530 includes ribs 534 or other suitable features to facilitate a user grasping and rotating the handle 530.

Figure 14:
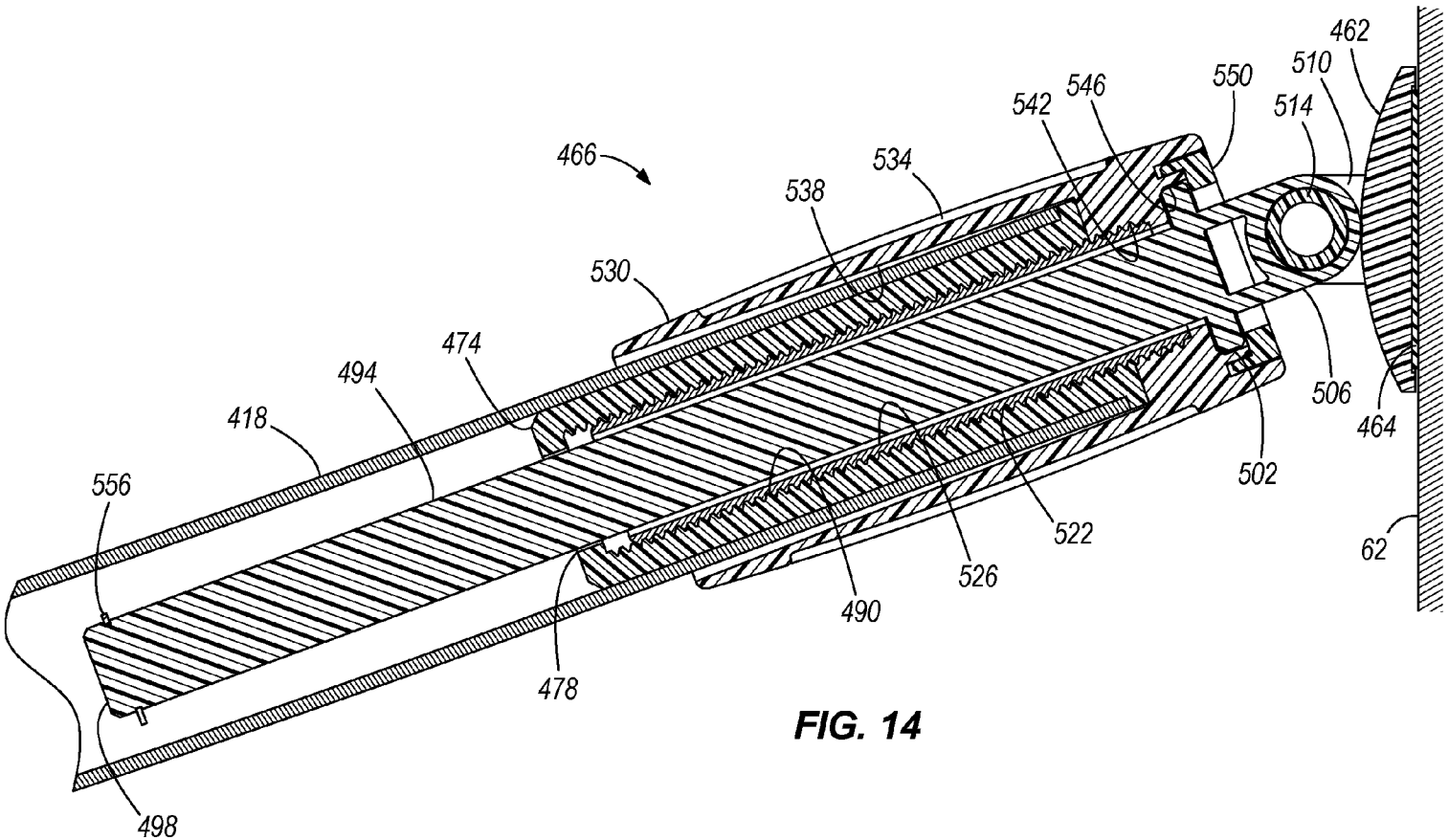
FIG. 14 is a section view of the adjustment mechanism of FIG. 13 in a first, retracted position.

As shown in FIG. 14, an inner bore 538 of the handle 530 includes a threaded portion 542 sized and configured to receive the threads on the outer surface of the threaded rod 522. The threaded portion 542 and the threaded rod 522 are fixed to one another to co-rotate. In other words, rotation of the handle 530 causes rotation of the threaded rod 522. Adhesives or other suitable securing methods can be used to secure the handle 530 and the threaded rod 522 together. Another portion 546 of the inner bore 538 is sized and configured to rotatably receive the disk portion 518 of the mounting shaft 494. A securing ring 550 is positioned into the end of the inner bore 538 over the disk portion 518 to secure the handle 530 over and onto the mounting shaft 494 such that the handle 530 can rotate relative to the mounting shaft 494. The securing ring 550 can have a snap-fit arrangement with the handle 530 and/or can be secured to the handle by adhesives or other suitable methods.

The adjustment mechanism 466 is assembled by positioning the threaded rod 522, the mounting shaft 494, and the rod insert 470 in the handle 530 as illustrated in FIG. 14. The rod insert 470 is then pressed into the rod member 414, with a portion of the rod member 414 received within the inner bore 538 of the handle 530. The threaded rod 522 is received in the threaded bore 490 of the rod insert 470. The mounting shaft 494 extends through the threaded rod 522 and into the rod insert 470, with the cross-shaped first end 498 received in the cross-shaped opening 478. A snap ring 556 is secured onto the first end 498 of the mounting shaft 494 after the first end 498 has been inserted through the cross-shaped opening 478 of the rod insert 470, but prior to insertion into the rod member 414, so that the first end 498 cannot be withdrawn through the cross-shaped opening 478, causing unintended disassembly of the adjustment mechanism 466.

In operation, a user or installer can install the rod assembly 410 into the correct position in the opening of the shower enclosure 14 by first mounting the wall plates 462 in the appropriate positions on the opposing mounting surfaces 62. Next, the fastener-receiving members 506 of the mounting shafts 494 are positioned relative to the mounting plates 462 so the fasteners 514 can be secured through the aligned fastener-receiving members 510 and 506. To add tension and fully secure the rod assembly 410 in place, the user rotates one or both of the handles 530 about its longitudinal axis in a first direction.

Figure 15:
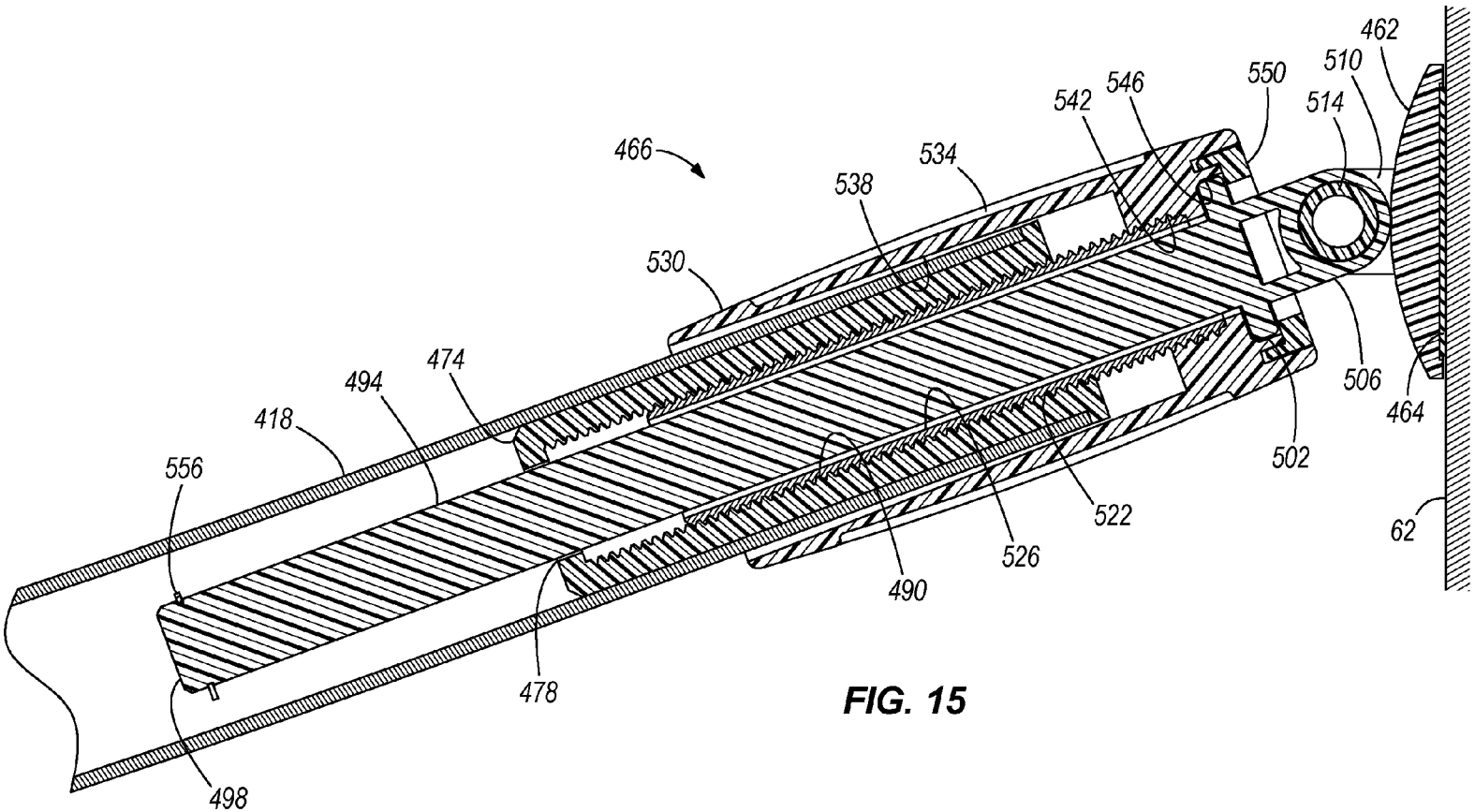
FIG. 15 is a section view of the adjustment mechanism of FIG. 13 in a second, extended position.

With reference to FIGS. 14 and 15, as the user rotates the handle 530, the threaded rod 522 rotates with the handle 530. Rotation of the threaded rod 522 within the threaded bore 490 of the rod insert 470 causes the handle 530 and the threaded rod 522 to travel relative to the rod insert 470 in a direction toward the mounting surface 62 and away from the rod member 414 from a first, retracted position (see FIG. 14) to a second, extended position (see FIG. 15). As the mounting shaft 494 is movable with the handle 530 due to the disk portion 518 being rotatably captured in the portion 546 of the handle 530, the mounting shaft 494 also extends (translating without rotation) relative to the rod insert 470 in a direction toward the mounting surface 62 and away from the rod member 414. In actuality, since the mounting shaft 494 is fixed to the wall plate 462 via the fastener 514, the extension of the threaded rod 522 and the mounting shaft 494 from the rod insert 470 actually causes the rod insert 470 and the associated end of the rod member 414 to move away from the wall plate 462.

From the outside, the user will only see the handle 530 translating along the rod member 414 toward the wall plate 462. However, such translation of the handle 530 will cause increased compressive force to be applied by the mounting shaft 494 onto the wall plate 462, and therefore onto the support surface 62. The rod assembly 410 thereby extends to apply compressive force on the support surface 62. Because the rod member 414 can bow as compressive forces increase, and because the force is not transmitted in a normal direction to the mounting surfaces 62, there is actually little chance of damaging the support surfaces 62 by over-torquing the handles 530. Therefore, the adjustment mechanism 466 can be used without a clutching mechanism.

To reduce the tension on the rod assembly 410 in order to remove it from between the wall plates 462, the user rotates the handle 530 in the opposite second direction, causing the handle 530, the threaded rod 522, and the mounting shaft 494 to move in the opposite direction back toward the rod member 414 and away from the mounting plate 462 thereby reducing the compressive force exerted by the handle 530, onto the mounting shaft 494, and onto the support surface 62 via the wall plate 462. The fasteners 514 can then be removed so the rod assembly 410 is free to be taken off the wall plates 462.

Various features and advantages of the invention are set forth in the following claims.

What is claimed is:

1. An adjustable curved curtain rod assembly comprising:
a curved rod member; and
an adjustment mechanism coupled to an end of the curved rod member, the adjustment mechanism operable to adjust a length of the rod assembly and having
a handle rotatable relative to the curved rod member, and
a mounting shaft coupled with the handle;
wherein rotation of the handle causes relative extension and retraction between the mounting shaft and the curved rod member to respectively increase and decrease the length of the rod assembly; and
wherein the adjustment mechanism further includes a rod insert positioned in the end of the curved rod member and receiving the mounting shaft such that the mounting shaft cannot rotate relative to the curved rod member.

2. The adjustable curved curtain rod assembly of claim 1, wherein the mounting shaft is coupled to a support surface via a mounting plate, the mounting plate being secured to the support surface using only an adhesive.

3. The adjustable curved rod assembly of claim 1, wherein the rod insert includes a cross-shaped opening and wherein the mounting shaft includes a cross-shaped end received in the cross-shaped opening of the rod insert.

4. The adjustable curved curtain rod assembly of claim 1, wherein the adjustment mechanism further includes a threaded rod rotatable with the handle and received within a threaded bore of the rod insert such that rotation of the handle creates movement of the handle, the mounting shaft, and the threaded rod relative to the rod insert and the curved rod member.

5. The adjustable curved curtain rod assembly of claim 1, wherein the rod insert is press-fit into the curved rod member such that the rod insert cannot rotate relative to the curved rod member.

6. The adjustable curved curtain rod assembly of claim 1, wherein the adjustment mechanism is a first adjustment mechanism coupled to a first end of the curved rod member, and the adjustable curved curtain rod assembly further comprising a second adjustment mechanism coupled to a second end of the curved rod member, the second adjustment mechanism being substantially the same as the first adjustment mechanism.

7. The adjustable curved curtain rod assembly of claim 1, wherein the curved rod member includes two distinct curved rod members connected together by a connector assembly.

8. The adjustable curved curtain rod assembly of claim 7, wherein the connector assembly includes a male connector received in an end of one of the two distinct curved rod members and a female connector received in an end of the other of the two distinct curved rod members, the male connector further received in the female connector such that the connectors and the two distinct curved rod members are all connected and non-rotatable relative to each other.

9. The adjustable curved curtain rod assembly of claim 8, wherein the female connector includes a cross-shaped bore and wherein the male connector includes a cross-shaped end received in the cross-shaped bore of the female connector.

10. The adjustable curved curtain rod assembly of claim 8, wherein the connectors and the distinct curved rod members include a projection and notch arrangement to facilitate alignment and anti-rotation of the connectors relative to the distinct curved rod members.

11. The adjustable curved curtain rod assembly of claim 7, wherein the curved rod member has a constant outer diameter.

12. The adjustable curved curtain rod assembly of claim 1, wherein the mounting shaft is coupled to a support surface via a mounting plate.

13. The adjustable curved curtain rod assembly of claim 12, wherein the mounting plate includes a fastener receiving member sized and configured to receive a fastener coupled to the mounting shaft.

14. The adjustable curved curtain rod assembly of claim 13, wherein the mounting plate includes a pair of spaced-apart fastener receiving members, and wherein the mounting shaft includes a fastener receiving member sized and configured to fit between the spaced-apart fastener receiving members of the mounting plate such that a fastener can extend through the fastener receiving members of the mounting plate and the fastener receiving member of the mounting shaft.

15. The adjustable curved curtain rod assembly of claim 1, further comprising a securing member received in the handle to axially secure the mounting shaft in the handle.

16. The adjustable curved curtain rod assembly of claim 15, wherein the securing member is a ring.

17. The adjustable curved curtain rod assembly of claim 15, wherein the mounting shaft includes a disk portion, and wherein the securing member is positioned against the disk portion.

18. The adjustable curved curtain rod assembly of claim 17, wherein the handle includes an inner bore portion sized and configured to receive the disk portion of the mounting shaft.

* * * * *